US009298125B2

(12) United States Patent
Sugiyama et al.

(10) Patent No.: US 9,298,125 B2
(45) Date of Patent: Mar. 29, 2016

(54) IMAGE FORMING APPARATUS AND IMAGE FORMING METHOD

(71) Applicants: Hiroyuki Sugiyama, Kanagawa (JP); Takamasa Ozeki, Kanagawa (JP); Tomoko Takahashi, Kanagawa (JP); Yoshinori Nakagawa, Kanagawa (JP); Masahiko Shakuto, Kanagawa (JP); Ryuji Yoshida, Kanagawa (JP); Taichi Urayama, Kanagawa (JP); Ryusuke Mase, Kanagawa (JP); Shotaro Hoshi, Kanagawa (JP)

(72) Inventors: Hiroyuki Sugiyama, Kanagawa (JP); Takamasa Ozeki, Kanagawa (JP); Tomoko Takahashi, Kanagawa (JP); Yoshinori Nakagawa, Kanagawa (JP); Masahiko Shakuto, Kanagawa (JP); Ryuji Yoshida, Kanagawa (JP); Taichi Urayama, Kanagawa (JP); Ryusuke Mase, Kanagawa (JP); Shotaro Hoshi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/529,847

(22) Filed: Oct. 31, 2014

(65) Prior Publication Data

US 2015/0117884 A1 Apr. 30, 2015

(30) Foreign Application Priority Data

Oct. 31, 2013 (JP) ..... 2013-226276

(51) Int. Cl.
*G03G 15/06* (2006.01)
*G03G 15/00* (2006.01)

(52) U.S. Cl.
CPC ..... *G03G 15/065* (2013.01); *G03G 15/5041* (2013.01); *G03G 15/5058* (2013.01)

(58) Field of Classification Search
CPC ..... G03G 15/0266; G03G 15/5041; G03G 15/5033; G03G 15/5058
See application file for complete search history.

(56) References Cited

U.S. PATENT DOCUMENTS

2004/0218940 A1 11/2004 Kosugi et al.
2007/0253726 A1* 11/2007 Kagawa ..... G03G 15/0216 399/100
2009/0175635 A1* 7/2009 Naoi et al. ..... 399/38
2010/0329722 A1* 12/2010 Funayama et al. ..... 399/72
2011/0058832 A1 3/2011 Suzuki et al.

(Continued)

FOREIGN PATENT DOCUMENTS

JP 2004-184583 7/2004
JP 2006-071802 3/2006

(Continued)

OTHER PUBLICATIONS

U.S. Appl. No. 14/539,330, filed Nov. 12, 2014, Sugiyama, et al.

(Continued)

*Primary Examiner* — Gregory H Curran
(74) *Attorney, Agent, or Firm* — Oblon, McClelland, Maier & Neustadt, L.L.P.

(57) ABSTRACT

An image forming apparatus includes a latent image bearing member, a charging unit, a charging power source, a latent image writing unit, a development unit, a transfer unit, a toner detector, and a controller. The controller causes a background fog pattern to be formed on a surface of the latent image bearing member. In addition to the background fog pattern, the controller causes a latent image to be developed to form a toner image used for position identification on the surface of the latent image bearing member. The controller identifies a time when the toner image used for position identification has entered a detection range of the toner detector based on a change in outputs of the toner detector to determine a time when each of sections of the background fog pattern enters the detection range based on the identified time.

11 Claims, 15 Drawing Sheets

(56) References Cited

U.S. PATENT DOCUMENTS

| | | | | |
|---|---|---|---|---|
| 2011/0222869 | A1* | 9/2011 | Sakatani | 399/15 |
| 2014/0064756 | A1 | 3/2014 | Sugiyama et al. | |
| 2014/0348521 | A1 | 11/2014 | Mase et al. | |

FOREIGN PATENT DOCUMENTS

| | | |
|---|---|---|
| JP | 2007-093775 | 4/2007 |
| JP | 2007-279277 | 10/2007 |
| JP | 2008-083461 | 4/2008 |

OTHER PUBLICATIONS

U.S. Appl. No. 14/275,038, filed May 12, 2014.

* cited by examiner

IMAGE FORMING APPARATUS AND IMAGE FORMING METHOD

CROSS-REFERENCE TO RELATED APPLICATION

This patent application is based on and claims priority pursuant to 35 U.S.C. §119 to Japanese Patent Application No. 2013-226276, filed on Oct. 31, 2013, in the Japan Patent Office, the entire disclosure of which is hereby incorporated by reference herein.

BACKGROUND

1. Technical Field

Exemplary aspects of the present invention relate to an image forming apparatus and an image forming method, and more particularly, to adjustment of an output value of a charging bias based on a toner adhesion amount of each area in a movement direction of a background fog pattern formed on a surface of a latent image bearing member, and an image forming apparatus implementing the adjustment.

2. Related Art

Conventionally, image forming apparatuses that form an image using an electrophotographic process are known.

In such an image forming apparatus, a charging device uniformly charges a surface of a photosensitive member serving as a latent image bearing member. Meanwhile, the surface of the photosensitive member, having passed a charge position opposite the charging device, is irradiated by an optical scanner, thereby forming an electrostatic latent image on the surface of the photosensitive member that is conveyed to a development position opposite a development device, which develops the electrostatic latent image into a toner image. Subsequently, the toner image on the surface of the photosensitive member is conveyed to a transfer position opposite a transfer unit that transfers the toner image to a recording sheet directly or via an intermediate transfer member.

In such an, electrophotographic process, a charging bias to be supplied to the charging device is controlled to be constant. However, such straightforward control cannot maintain a constant electric potential of a background area on the surface of the photosensitive member for long because the potential of the background area changes with changes in the environment (e.g., temperature and humidity), changes in electrical resistance of a charging member (e.g., a charging roller) in the charging device over time, and changes in thickness (e.g., abrasion) of a surface layer of the photosensitive member.

The change in the potential of the background area may cause various problems due to excessive or insufficient background potential that is the difference between the potential of the background area and the potential of a development member (e.g., a development roller) of a development device. For example, insufficient background potential may cause background fogging due to transfer of toner on the development member to the background area on the surface of the photosensitive member. Moreover, in an image forming apparatus employing a two-component development method that uses a two-component developer containing toner and magnetic carrier as a developer, excessive background potential may cause a phenomenon called carrier adhesion, in which the magnetic carrier on a development member is transferred to a surface of a photosensitive member.

SUMMARY

In at least one embodiment of this disclosure, there is provided an image forming apparatus including a latent image bearing member, a charging unit, a charging power source, a latent image wiring unit, a development unit, a transfer unit, a toner detector, and a controller. The charging unit charges a surface of the latent image bearing member. The charging power source outputs a charging bias to be supplied to the charging unit. The latent image writing unit writes a latent image on the surface of the latent image bearing member charged by the charging unit. The development unit develops the latent image to form a toner image. The transfer unit transfers the toner image on the surface of the latent image bearing member to a transfer member. The toner detector detects a toner adhesion amount on at least one of the surface of the latent image bearing member and a surface of the transfer member. The controller gradually changes a background potential serving as a potential difference between a background area of the latent image bearing member and a development member of the development unit while causing the latent image bearing member to rotate, thus forming a background fog pattern on the surface of the latent image bearing member. The background fog pattern includes only a blank area corresponding to the background area. The controller adjusts the charging bias from the charging power source based on a detection of a toner adhesion amount by the toner detector for each of sections of the background fog pattern in a movement direction. The controller develops a latent image to form a toner image used for position identification on the surface of the latent image bearing member in addition to the background fog pattern. The controller identifies a time when the toner image used for position identification has entered a detection range of the toner detector based on a change in outputs of the toner detector to determine a time when each of the sections enters the detection range based on the identified time.

In at least one embodiment of this disclosure, there is provided an image forming method including outputting a charging bias, charging a surface of a latent image bearing member, writing a latent image, developing the latent image, transferring a toner image, detecting a toner adhesion amount, forming a background fog pattern, and adjusting the charging bias. The charging bias is output from a charging power source to charge a latent image bearing member. The surface of the latent image bearing member is charged with the charging bias by a charging unit. The latent image is written on the surface of the latent image bearing member charged by the charging unit. The latent image is developed to form a toner image by a development unit. The toner image on the surface of the latent image bearing member is transferred to a transfer member. The toner adhesion amount on the surface of the latent image bearing member or a surface of the transfer member is detected by a toner detector. The background fog pattern is formed on the surface of the latent image bearing member by gradually changing a background potential serving as a potential difference between a background area of the latent image bearing member and a development member of the development unit while the latent image bearing member is rotating. The background fog pattern includes only a blank area corresponding to the background area. The charging bias from the charging power source is adjusted based on the toner adhesion amount detected by the toner detector for each of sections of the background fog pattern in a movement direction. The adjusting includes developing a latent image to form a toner image used for position identification, identifying a time when the toner image used for position identification has entered a detection range, and determining a time when each of the sections enters the detection range. The latent image is developed to form the toner image used for position identification on the surface of the latent image bearing member, in addition to the background fog pattern. The time when the toner image used for position identification has entered the detection range of the toner detector is identified based on a change in outputs of the toner detector. The time when each of the sections enters the detection range is determined based on the identified time.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
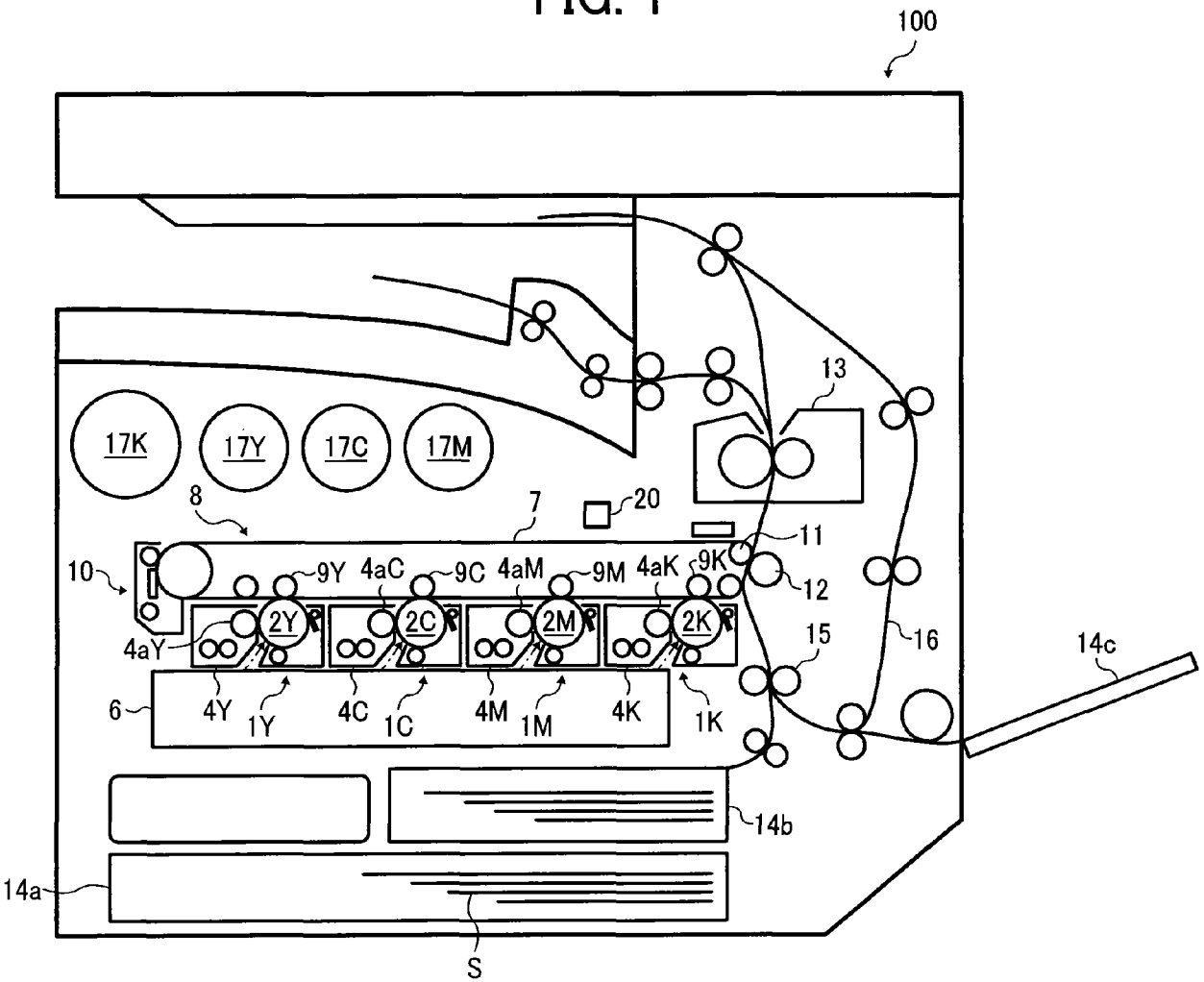
FIG. 1 is a schematic view of a printer according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the drawings for describing the following exemplary embodiments, the same reference numbers are allocated to elements (members or components) having the same function or shape and redundant descriptions thereof are omitted below.

In an electrophotographic image forming apparatus, the smaller the absolute value of a charging bias, the less likely is carrier adhesion to occur. However, the smaller the absolute value of the charging bias, the more likely the background fog is generated. Accordingly, if an absolute value of the charging bias is decreased to a lowest possible value that can still suppress generation of the background fog, then not only the background fog but also carrier adhesion may be suppressed.

In a photosensitive member of the image forming apparatus, a background potential suppresses transfer of toner from a development member to a background area, while the background potential facilitates transfer of toner to an electrostatic latent image. Thus, unlike with the electrostatic latent image, even if background fog is generated in the background area of the photosensitive member, a toner adhesion amount is very small in the background area. Consequently, among all sections in a background fog pattern, even a section causing the background fog has a very small amount of toner adhesion, and a section not causing the background fog has a toner adhesion amount of almost zero. Accordingly, when a leading end of such a background fog pattern enters a detection range in which a toner adhesion amount detection sensor detects a toner adhesion amount, there may be no significant change in output values of the toner adhesion amount detection sensor. Moreover, even when the section to be detected in the detection range is changed to another section with movement of the background fog pattern, outputs from the toner adhesion amount detection sensor may not change significantly. Consequently, the image forming apparatus cannot specify a time when each section of the background fog pattern has entered the detection range based on the changes in output values of the toner adhesion amount detection sensor.

Generally, the image forming apparatus uses a clock process to determine a time when each section of the background fog pattern enters detection range. In particular, when the image forming apparatus gradually changes a charging bias, the clock process is started at a first bias value being set. Subsequently a time when a clock value reaches t1 is determined as a detection range entry time for a first section of the background fog pattern. Moreover, a time when a clock value reaches t2 (where t1<t2) is determined as a detection range entry time for a second section of the background fog pattern. A detection range entry time for each of the other sections can also be similarly determined.

When such a clock process is used to determine a time when each section enters the detection range, a surface of a photosensitive member needs to move continuously and stably at a prescribed linear velocity. If the surface of the photosensitive member cannot move as prescribed, the determined entry time for each section may be shifted from the actual entry time.

Hence, according to embodiments of the present disclosure, an image forming apparatus and an image forming method can prevent background fog and carrier adhesion caused by poor accuracy in identifying a time when each section of a background fog pattern enters a detection range.

Hereinafter, an electrophotographic printer 100 is described as one example of an image forming apparatus according to an exemplary embodiment of the present invention. FIG. 1 is a schematic diagram of the printer 100. The printer 100 includes four image forming units 1Y, 1C, 1M, and 1K to form images of yellow (Y), cyan (C), magenta (M), and black (K), respectively. Hereinafter, members with letters Y, C, M, and K indicate members for yellow, cyan, magenta, and black, respectively. In FIG. 1, the Y, C, M and K are arranged in this order. However, the color order is not limited thereto. The Y, C, M, and K may be arranged in another order.

Figure 2:
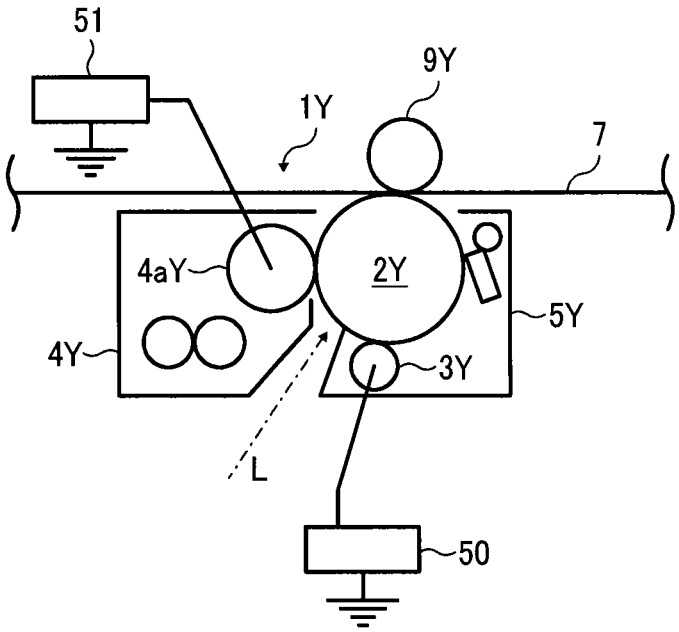
FIG. 2 is a schematic view of an image forming unit of the printer.

FIG. 2 is a schematic view of the image forming unit 1Y of the printer 100. Since each of the image forming units 1C, 1M, and 1K is substantially similar to every other except for the color of toner therein, the image forming unit 1Y is described with reference to FIG. 2 as representative of all the image forming units 1C, 1M, and 1K. As illustrate in FIG. 2, the image forming unit 1Y includes a drum-shaped photosensitive member 2Y serving as a latent image bearing member, a charging roller 3Y serving as a charging unit, a development device 4Y serving as a development unit, and a cleaning device 5Y. The charging roller 3Y, the development device 4Y, and the cleaning device 5Y are disposed around the photosensitive member 2Y. The charging roller 3Y formed of a rubber roller rotates while contacting a surface of the photosensitive member 2Y. In the printer 100, the charging roller 3Y employs a contact direct current (DC) charging method by which a DC bias excluding an alternating current (AC) component is applied as a charging bias. Alternatively, the charging roller 3Y may employ another method such as a contact AC charging roller method or a non-contact charging roller method.

The development device 4Y stores a two-component developer containing a yellow toner and a magnetic carrier. The toner has an average diameter of between 4.9 μm and 5.5 μm. The carrier has a small diameter and a low resistance with a bridge resistance of 12.1 Log Ω·cm or less. The development device 4Y includes a development roller 4*a*Y serving as a developer bearing member disposed opposite the photosensitive member 2Y, a screw for conveying and agitating the developer, and a toner density sensor. The development roller 4*a*Y includes a rotatable sleeve and a magnet roller. The magnet roller is disposed inside the development roller 4*a*Y such that the magnetic roller is not rotated with rotation of the sleeve.

In the image forming unit 1Y, the photosensitive member 2Y, the charging roller 3Y, the development device 4Y, and the cleaning device 5Y are disposed as one process cartridge supported by a common supporting member. Accordingly, the image forming unit 1Y is detachable from a printer body, and consumable parts can be replaced with new ones at a time when the lifespan thereof ends.

Moreover, the printer 100 includes an optical writing unit 6 below the image forming units 1Y, 1C, 1M, and 1K. The optical writing unit 6 serving as a latent image writing unit includes a light source, a polygon mirror, an f–θ lens, and a reflection mirror to scan a surface of each of the photosensitive members 2Y, 2C, 2M, and 2K with a laser light L based on image data. Such optical scanning forms yellow, cyan, magenta, and black electrostatic latent images on the respective photosensitive members 2Y, 2C, 2M, and 2K.

The printer 100 also includes an intermediate transfer unit 8 above the image forming units 1Y, 1C, 1M, and 1K. The intermediate transfer unit 8 serving as a transfer unit includes an intermediate transfer belt 7, primary transfer rollers 9Y, 9C, 9M, and 9K, a cleaning device 10 including a brush roller and a cleaning blade, a secondary transfer backup roller 11, and an optical sensor unit 20. The intermediate transfer unit 8 transfers the toner images of different colors on the respective photosensitive members 2Y, 2C, 2M and 2K to a recording sheet S through the intermediate transfer belt 7. The intermediate transfer belt 7 extends across a plurality of rollers. In FIG. 1, the intermediate transfer belt 7 makes an endless movement in a counterclockwise direction with rotation of at least one of the rollers.

The primary transfer rollers 9Y, 9C, 9M, and 9K and the respective photosensitive members 2Y, 2C, 2M, and 2K nip the intermediate transfer belt 7. Thus, the photosensitive members 2Y, 2C, 2M, and 2K contact a front surface of the intermediate transfer belt 7 to form primary transfer nips for Y, M, C, and K. On a downstream side of the image forming unit 1K in a belt movement direction, the intermediate transfer unit 8 includes a secondary transfer roller 12 in a position outside a belt loop near the secondary transfer backup roller 11. The secondary transfer roller 12 and the secondary transfer backup roller 11 nip the intermediate transfer belt 7 to form a secondary transfer nip.

A fixing unit 13 is disposed above the secondary transfer roller 12. The fixing unit 13 includes a fixing roller and a pressure roller. The fixing roller and the pressure roller rotate and contact each other to form a fixing nip. The fixing roller includes a halogen heater thereinside, and electric power is supplied from a power source to the halogen heater such that a surface of the fixing roller has a predetermined temperature.

In a lower portion of the printer 100, sheet feed cassettes 14*a* and 14*b*, a feed roller, and a registration roller pair 15 are disposed. In each of the sheet feed cassettes 14*a* and 14*b*, a plurality of sheets S of recording media on which images are to be recorded is stacked and stored. On the side of the printer 100, a manual feed tray 14*c* is disposed so that a user can manually feed a sheet from the side. Moreover, in FIG. 1, a duplex unit 16 is disposed on the right side of the intermediate transfer unit 8 and the fixing unit 13. The duplex unit 16 conveys the recording sheet S to the secondary transfer nip again when the printer 100 forms images on two sides of the recording sheet S.

On an upper portion of the printer 100, toner replenishing containers 17Y, 17C, 17M, and 17K are disposed to replenish the respective development devices 4Y, 4C, 4M, and 4K of the image forming units 1Y, 1C, 1M, and 1K with the respective colors of toner. Moreover, the printer 100 includes a waste toner bottle and power source units.

Next, operations of the printer 100 are described. First, the power source unit applies a predetermined voltage to the charging roller 3Y to charge a surface of the photosensitive member 2Y disposed opposite the charging roller 3Y. The optical writing unit 6 scans the surface of the photosensitive member 2Y charged with a predetermined potential with the laser light L based on image data. This forms an electrostatic latent image on the photosensitive member 2Y. With rotation of the photosensitive member 2Y, the surface of the photosensitive member 2Y bearing the electrostatic latent image reaches the development device 4Y. Then, the development roller 4*a*Y disposed opposite the photosensitive member 2Y supplies Y toner to the electrostatic latent image on the surface of the photosensitive member 2Y thereby forming a Y-toner image on the surface of the photosensitive member 2Y. The toner replenishing container 17Y replenishes the development device 4Y with an appropriate amount of the Y toner according to an output of a toner density sensor.

Similarly, the image forming units 1C, 1M, and 1K perform such operations at prescribed times. Accordingly Y, C, M, and K-toner images are formed on the surfaces of the respective photosensitive members 2Y, 2C, 2M, and 2K. In the Y, C, M, and K primary nips, the Y, C, M, and K toner images are sequentially superimposed and primarily transferred onto a front surface of the intermediate transfer belt 7. Such primary transfer is performed by applying a voltage having a polarity opposite to the toner to the primary transfer rollers 9Y, 9C, 9M, and 9K by a transfer power source.

A recording sheet S is conveyed from any of the sheet feed cassettes 14*a* and 14*b* and the manual feed tray 14*c*. When the recording sheet S reaches the registration roller pair 15, the conveyance of the recording sheet S temporarily stops. With rotation of the registration roller pair 15, the recording sheet S is fed toward the secondary nip at prescribed times.

The Y, C, M, and K toner images superimposed on the intermediate transfer belt 7 are secondarily transferred to the recording sheet S in the secondary transfer nip in which the secondary transfer roller 12 and the intermediate transfer belt 7 contact each other. The secondary transfer is performed by applying a voltage having a polarity opposite to the toner to the secondary transfer roller 12 by a secondary transfer power source. After passing the secondary nip, the recording sheet S is conveyed toward the fixing unit 13 and nipped in the fixing nip. In the fixing nip, the toner image on the recording sheet S is fixed with heat from the fixing roller. When one-side printing is performed, the sheet S with the fixed toner image is discharged outside the printer 100 by conveyance rollers. When two-sided printing is performed, the sheet S is conveyed to the duplex unit 16 by conveyance rollers and reversed, so that an image is formed on the other side of the sheet S. Then, the sheet S is discharged outside the printer 100.

In the printer 100, a control operation called a process control is executed at prescribed times to maintain image quality that may be degraded over time or affected by environmental changes. In the process control, the printer 100 develops a Y patch pattern image including a plurality of patch-like Y toner images on the photosensitive member 2Y, and transfers the Y patch pattern image to the intermediate transfer belt 7. Similarly, the printer 100 forms C, M, and K patch pattern images on the respective photosensitive members 2C, 2M, and 2K. The optical sensor unit 20 detects a toner adhesion amount of each of the toner images in the Y, C, M, and K patch pattern images. Accordingly, the printer 100 adjusts an image forming condition such as a development bias Vb based on the detection results. Hereinafter, the Y, C, M, and K patch pattern images are also called YPP, CPP, MPP, and KPP images, respectively.

Figure 3:
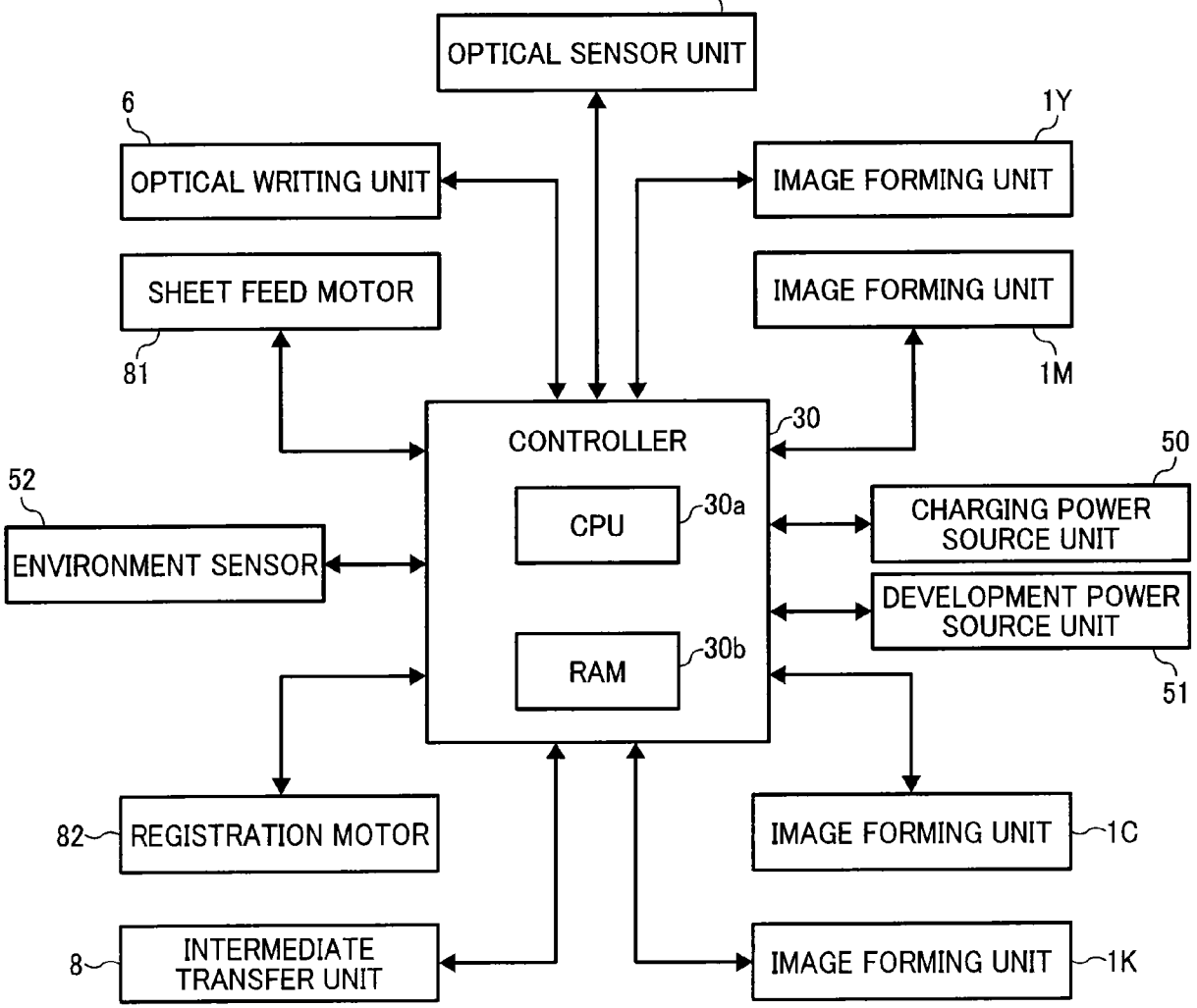
FIG. 3 is a block diagram of a principal portion of an electric circuit of the printer.
Figure 4:
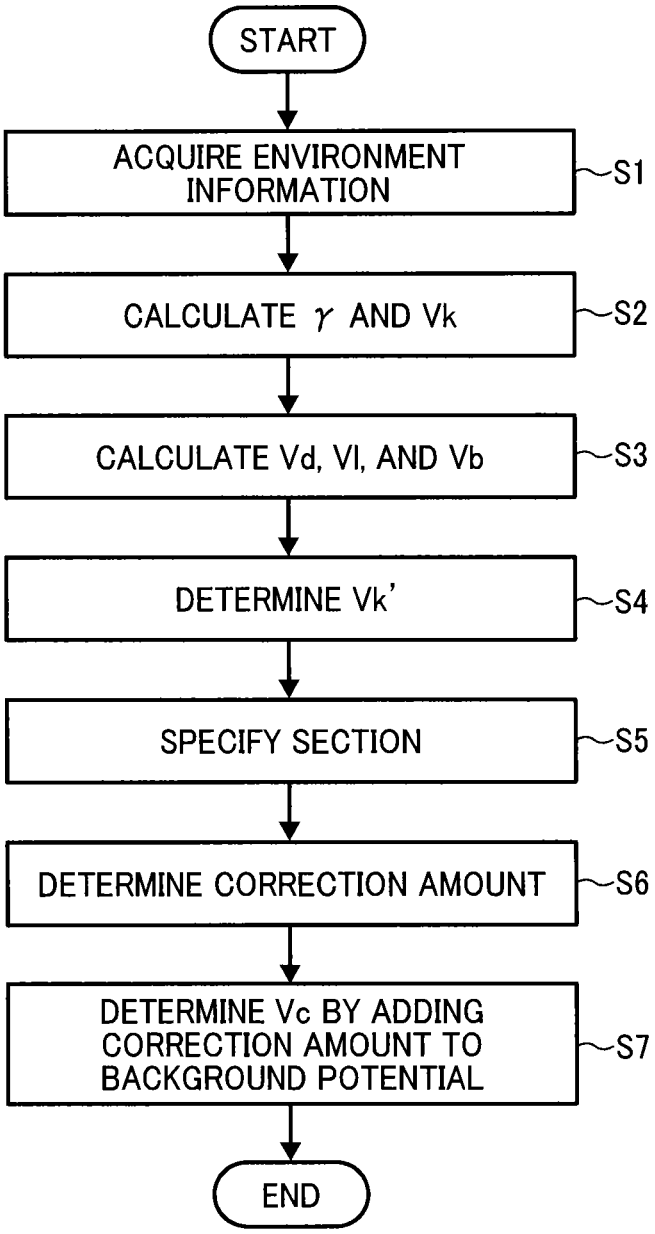
FIG. 4 is a flowchart of a calculation process performed in process control.

FIG. 3 is a block diagram of a principal portion of an electric circuit of the printer 100, whereas FIG. 4 is a flowchart of a calculation process performed in the process control. As illustrated in FIG. 3, the image forming units 1Y, 1C, 1M, and 1K, the optical writing unit 6, a sheet feed motor 81, a registration motor 82, the intermediate transfer unit 8, and the optical sensor unit 20 are electrically connected to a controller 30. The controller 30 includes a central processing unit (CPU) 30*a* executing an arithmetic process and various programs, and a random access memory (RAM) 30*b* storing data. The sheet feed motor 81 serves as a drive source of feed rollers for the sheet feed cassettes 14*a* and 14*b* and the manual feed tray 14*c*. Moreover, the registration motor 82 serves a drive source of the registration roller pair 15.

The optical sensor unit 20 includes four reflective photo sensors 20*a*, 20*b*, 20*c*, and 20*d* arranged with a predetermined distance therebetween in a belt width direction of the intermediate transfer belt 7. Each of the reflective photo sensors 20*a*, 20*b*, 20*c*, and 20*d* serves as a toner detector, and is arranged to output a signal according to a light reflectance of the intermediate transfer belt 7 or the patch-like toner image on the intermediate transfer belt 7. Three reflective photo sensors 20*a*, 20*b*, and 20*d* receive both regular reflection light and diffuse reflection light on the surface of the intermediate transfer belt 7 to output signals according to an amount of each of the received lights for the Y, M, and C toner images or toner adhesion amounts of Y, C, and M. The reflective photo sensor 20*c* receives only a regular reflection light on the surface of the intermediate transfer belt 7 to output a signal according to an amount of the received light for the K toner image or a toner adhesion amount of K.

The controller 30 executes the process control at prescribed times, for example, when a main power source of the printer 100 is turned on, when the printer 100 shifts to a standby state after predetermined time has elapsed, and the printer 100 shifts to a standby state after the predetermined number of sheets have been printed. Particularly, in step S1 of the flowchart illustrated in FIG. 4, when the predetermined timing comes, the controller 30 acquires environmental information such as the number of fed sheets, a printing ratio, temperature, and humidity. In step S2, the controller 30 calculates development characteristics of each of the image forming units 1Y, 1C, 1M, and 1K. In particular, the controller 30 calculates a development gamma γ and a development start voltage Vk for each color. That is, the photosensitive members 2Y 2C, 2M, and 2K are rotated and uniformly charged. In the charging operation in step S2, the controller 30 increases an absolute value of a voltage serving as a charging bias Vc, unlike normal printing in which a uniform voltage (e.g., −700 V) is applied. The optical writing unit 6 scans the surfaces of the photosensitive members 2Y, 2C, 2M, and 2K with a laser light L to form electrostatic latent images for the patch-like Y toner image, the patch-like C toner image, the patch-like M toner image, and the patch-like K toner image on the respective photosensitive members 2Y, 2C, 2M, and 2K. The development devices 4Y, 4C, 4M, and 4K develop such electrostatic latent images, thereby forming the YPP, CPP, MPP, and KPP images on the respective photosensitive members 2Y, 2C, 2M, and 2K. When the development operation is performed, the controller 30 gradually increases an absolute value of a development bias Vb to be applied to each of the development rollers 4*a*Y, 4*a*C, 4*a*M, and 4*a*K from a development power source unit 51. Each of the development bias Vb and the charging bias Vc is a direct current (DC) bias having a negative polarity.

Figure 5:
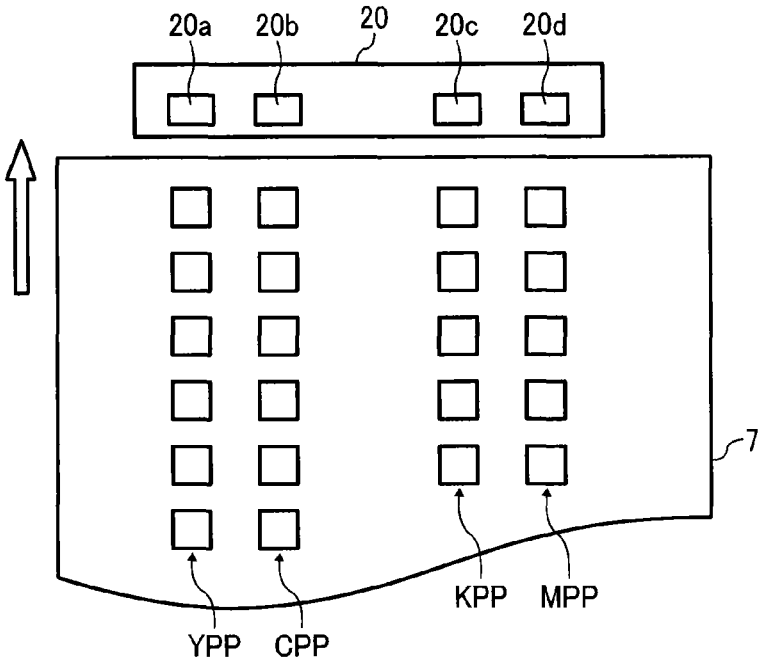
FIG. 5 is a schematic diagram of a patch pattern image on an intermediate transfer belt.

As illustrated in FIG. 5, the YPP, CPP, MPP, and KPP images are transferred to the intermediate transfer belt 7 such that the YPP, CPP, MPP, and KPP images are arranged in a belt width direction without overlapping one another. Particularly, the YPP image is transferred to a first side of the intermediate transfer belt 7 in the width direction. The CPP image is transferred to a position slightly displaced from the YPP image toward a middle portion of the intermediate transfer belt 7. The MPP image is transferred to a ~~YY~~ of the intermediate transfer belt 7 in the width direction opposite the first side, whereas the KPP image is transferred to a position slightly displaced from the MPP image toward the middle portion of the intermediate transfer belt 7. An arrow illustrated in FIG. 5 indicates a belt movement direction.

The optical sensor unit 20 includes the first reflective photo sensor 20*a*, the second reflective photo sensor 20*b*, the third reflective photo sensor 20*c*, and the fourth reflective photo sensor 20*d* that are arranged in different positions in the belt width direction to detect light reflection characteristics of the intermediate transfer belt 7. The third reflective photo sensor 20*c* detects only the regular reflection light. Such a configuration allows detection of a change in the light reflection characteristics of the surface of the intermediate transfer belt 7, the change being caused by adhesion of the black toner. On the other hand, each of the first, second, and fourth reflective photo sensors 20*a*, 20*b*, and 20*d* detects the regular reflection light and the diffuse reflection light. This allows detection of changes in the light reflection characteristics of the surface of the intermediate transfer belt 7, the changes being caused by adhesion of the Y, C, or M toners.

The first reflective photo sensor 20*a* is positioned to detect a Y-toner adhesion amount of the patch-like Y toner images of the YPP image. The second reflective photo sensor 20*b* is positioned to detect a C-toner adhesion amount of the patch-like C toner images of the CPP image formed in a position near the YPP image in the belt width direction. Moreover, the fourth reflective photo sensor 20*d* is positioned to detect an M-toner adhesion amount of the patch-like M toner images of the MPP image firmed on the second end of the intermediate transfer belt 7 in the belt width direction. The third reflective photo sensor 20*c* is positioned to detect a K-toner adhesion amount of the patch-like K toner images of the KPP image formed near the MPP image in the belt width direction. As long as the toner images of three colors (Y, C, M) excluding black are formed, the first, second and fourth reflective photo sensors 20*a*, 20*b*, and 20*d* can detect the toner adhesion amounts of the respective colors.

The controller 30 calculates a light reflectance of each color of the patch-like toner images based on output signals sequentially transmitted from the four reflective photo sensors 20*a*, 20*b*, 20*c*, and 20*d* of the optical sensor unit 20. The controller 30 determines the toner adhesion amounts based on the calculation results, and stores the resultant adhesion amounts in the RAM 30*b*. With the movement of the intermediate transfer belt 7, each of the YPP, CPP, KPP, and MPP images having passed a position opposite the optical sensor unit 20 is removed from the front surface of the intermediate transfer belt 7 by the cleaning device 10.

Figure 6:
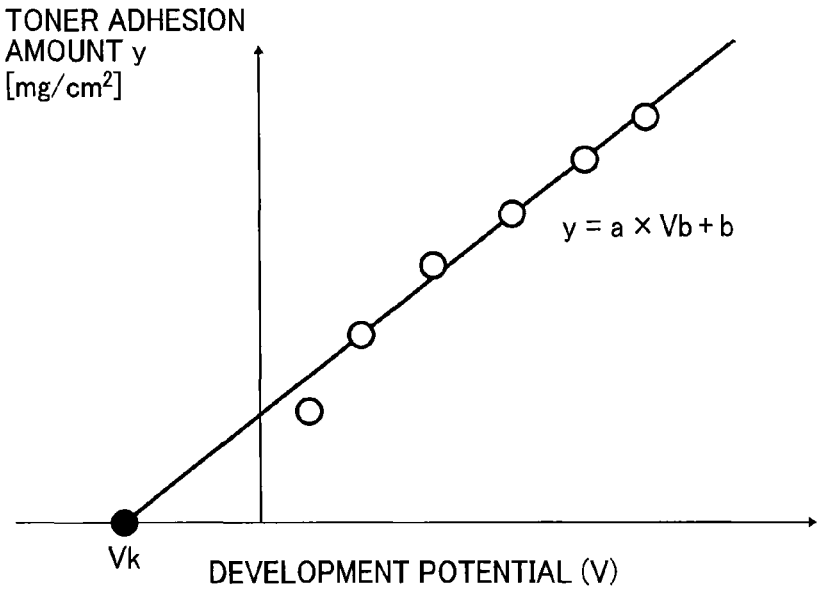
FIG. 6 is a graph of a relationship between a development potential and a toner adhesion amount.

Next, the controller 30 calculates a linear approximation equation ($y=a\times Vb+b$) illustrated in FIG. 6 from image density data (toner adhesion amount) stored in the RAM 30*b* and irradiated area potential (latent image potential) data stored in a RAM 150*b*. In two-dimensional coordinates illustrated in FIG. 6, an X axis indicates a value determined by subtracting a development bias Vb applied at a given time from an irradiated area potential V1. That is, the X-axis indicates a development potential (V1−Vb). Meanwhile, the Y-axis indicates a toner adhesion amount (y) per unit area. On the X-Y plane illustrated in FIG. 6, the number of plotted data points corresponds to the number of patch-like toner images. The controller 30 determines a section of the linear approximation on the X-Y plane based on the plurality of plotted data points. Then, the controller 30 acquires the liner approximation equation ($y=a\times Vb+b$) by using the method of least squares in the determined section. Herein, the controller 30 calculates the development gamma γ and the development start voltage Vk based on the linear approximation equation. The development gamma γ is calculated as a gradient (γ=a) of the linear approximation, whereas the development start voltage Vk is calculated as an intersection ($Vk=-b/a$) of the linear approximation equation and the X-axis. Accordingly the controller 30 calculates the development characteristics of each of the image forming units 1C, 1M, and 1K in step S2.

Subsequently, in step S3, the controller 30 determines a target value of a charging potential Vd that is a background area potential (a target charging potential), a target value of the irradiated area potential V1 (a target irradiated area potential), and a development bias Vb based on the calculated development characteristics. Particularly the target charging potential and the target irradiated area potential are determined based on a predetermined table of relationships between the development gamma γ and the charging potential Vd and between the development gamma γ and the irradiated area potential V1. Therefore, the controller 30 can select the target charging potential and the target irradiated area potential suitable for the development gamma γ. Moreover, the development bias Vb is determined as follows. The controller 30 calculates a development potential to acquire a maximum toner adhesion amount based on a combination of the development gamma γ and the development start voltage Vk, and determines the development bias Vb that can obtain such a development potential. Then, the controller 30 determines the target charging potential based on the development bias Vb and a background potential. Since a surface of the development sleeve of each of the development rollers 4*a*Y, 4*a*C, 4*a*M, and 4*a*K has an amount of voltage that is substantially similar to that of the development bias Vb, the surface of each of the photosensitive members 2Y, 2C, 2M, and 2K is charged with the target charging potential. Accordingly, as long as the surfaces of the photosensitive members 2Y, 2C, 2M, and 2K are appropriately irradiated with lights, a target development potential and a target background potential can be obtained. Since each of the development devices 4Y, 4C, 4M, and 4K is substantially similar to every other except for the color of toner therein, and each of the photosensitive members 2Y, 2C, 2M, and 2K is also substantially similar to every other except for the color of toner therein, the color abbreviations are omitted in the description below for the sake of simplicity. Similarly, the color abbreviations Y, M, C, and K are omitted from the charging rollers 3 in the description below for the sake of simplicity.

The controller 30 then determines the charging bias Vc. Particularly, the charging bias Vc which can obtain the target charging potential varies according to an abrasion rate of a surface layer of the photosensitive member 2 or an electric resistance of the charging roller 3, the electric resistance being affected by environment. Hence, the controller 30 stores therein an algorithm for calculating the charging bias Vc, which can obtain the target charging potential, based on a combination of the environment (temperature and humidity) and a travel distance of the photosensitive member 2. This algorithm is formed beforehand experimentally. Accordingly, the controller 30 uses such an algorithm to determine the charging bias Vc, which can obtain the target charging potential, based on the combination of the environment (temperature and humidity) detected by an environment sensor 52 serving as an environment detector and the travel distance of the photosensitive member 2, the travel distance being stored in the RAM 30*b*.

As for properties of developer, a state of background fog in an initial period is better than that in a later period, whereas, a state of carrier adhesion (edge carrier adhesion) in an initial period is worse than that in a later period. Consequently, a suitable value of the background potential is increased with the use of the developer. Moreover, in a high-temperature and high-humidity environment in general, a charge amount of toner is lower, and thus, background fog is deteriorated. On the other hand, in a low-temperature and low-humidity environment, a carrier adhesion has a disadvantage. Hence, the background potential shifts to a suitable value by an image density control according to an initial/later period and the environment.

From experiments, a background potential that is suitable for reducing the background fog and the carrier adhesion to the target values or less is already determined for each condition. Accordingly, if there is information about deterioration in the carrier or the charging rollers 3 and information about environment such as changes in temperature and humidity the suitable background potential may be corrected to some extent. However, the suitable background potential may vary due to unexpected factors or experimental error. Meanwhile, since the development start voltage Vk can serve as a voltage to start the development operation on the photosensitive member 2, a value of the background potential needs to be substantially the same as an absolute value of the development start voltage Vk or greater; otherwise, the background fog may become worse.

Accordingly in step S4 of the flowchart illustrated in FIG. 4, the controller 30 determines a target development start voltage Vk'. The target development start voltage Vk' and environment information are linked and tabulated beforehand based on experiments. The controller 30 determines the target development start voltage Vk' by referring to the table according to the environment information acquired first. In step S5, the controller 30 specifies in which section the development start voltage Vk is based on a difference between the development start voltage Vk and the target development start voltage Vk'. For example, if the development start voltage Vk differs from the target development start voltage Vk' by +40 V or more, the controller 30 specifies that the development start voltage Vk is in a section 1. If the difference is less than +40 V and +20 V or more, the controller 30 specifies that the development start voltage Vk is in a section 2. If the difference is less than +20 V and 0 V or more, the development start voltage Vk is in a section 3. In step SG, after-specifying a section in which the development start voltage Vk is provided, the controller 30 determines a correction amount with respect to each section. Subsequently, in step S7, the controller 30 calculates a target background potential by adding the correction amount determined in step S6 to the background potential calculated from the charging potential Vd and the development bias Vb determined in step S3. The controller 30 determines the charging bias Vc which can provide this target background potential.

Figure 7:
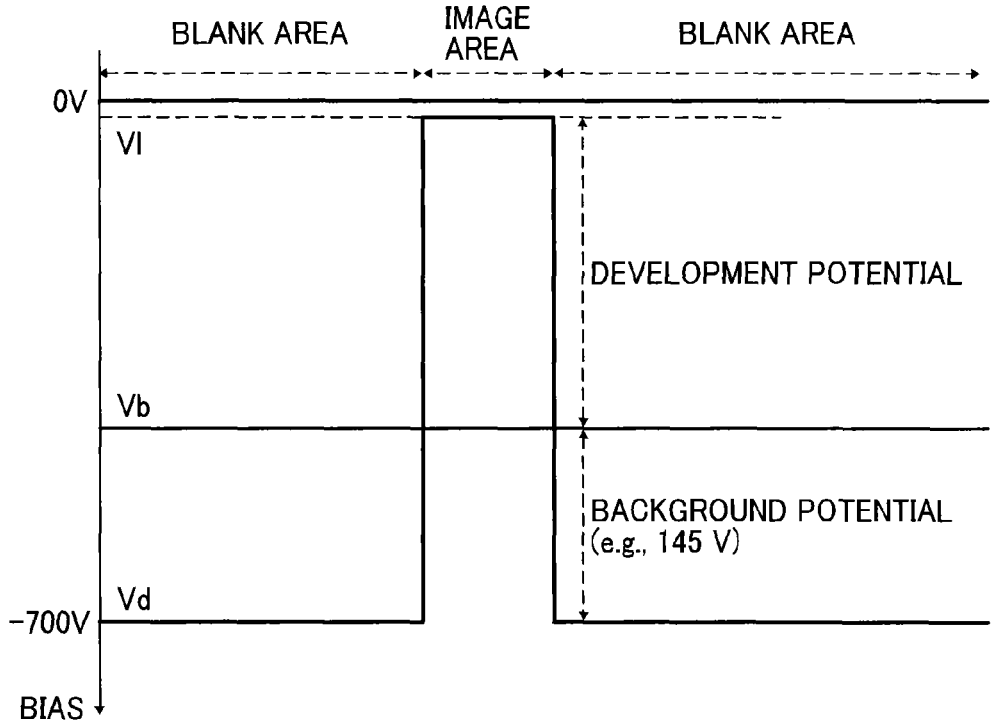
FIG. 7 is a graph of a development potential and a background potential.

FIG. 7 is a graph of a development potential and a background potential. As illustrated in FIG. 7, the background potential is a difference between the charging potential Vd and the development bias Vb, and acts on a blank area (a background area) of an image. The smaller the background potential, the more easily the background fog occurs. The larger the background potential, the more easily the carrier adhesion occurs. Consequently, the background potential needs to be set to an optimum value.

Figure 8:
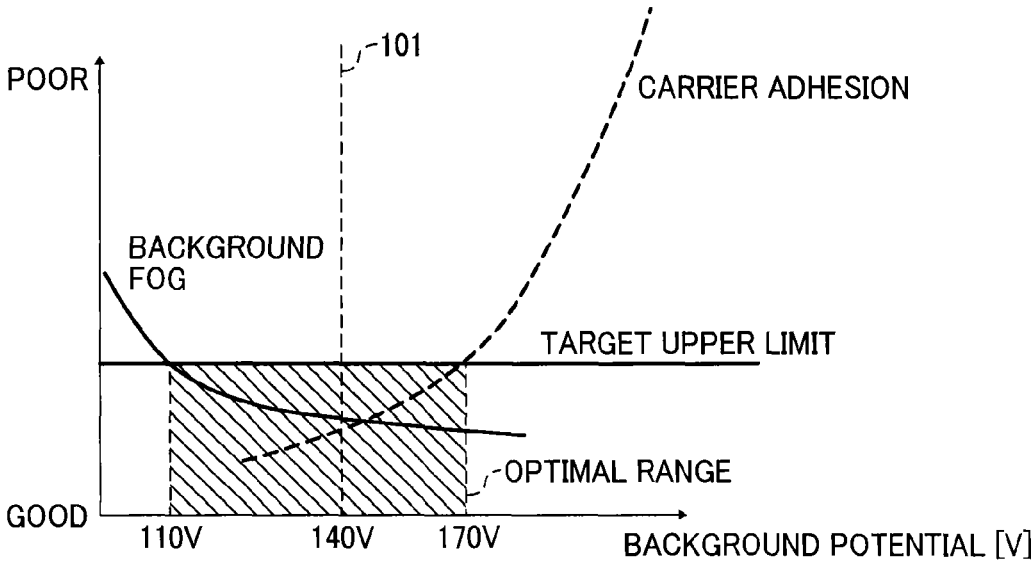
FIG. 8 is a graph of a relationship between a background potential and a degree of background fog, and a relationship between the background potential and a degree of carrier adhesion.

FIG. 8 is an example graph illustrating a relationship between a background potential and a degree of background fog, and a relationship between the background potential and a degree of carrier adhesion. In this example graph illustrated in FIG. 8, a theoretical value of the background potential is set to 140 V by execution of the process control. The theoretical value is used by following reasons. According to the process control, the background potential is determined based on the relationship between the appropriate charging potential Vd and the development bias Vb, so that the charging bias Vc is determined based on the resultant background potential as described above. However, the charging potential Vd may not be a target charging potential due to a change in the charging bias Vc. A discharge start voltage between the charging roller 3 and the photosensitive member 2 may be changed by various factors. Such a change in the discharge start voltage may change the charging bias Vc which is used to obtain the same charging potential Vd. In the process control, the environment and the travel distance of the photosensitive member 2 are considered when the charging bias Vc is determined. However, since such consideration is merely a theoretical algorithm, the determination may not always be made accordingly. Moreover, a value of the charging bias Vc to obtain the same charging potential Vd may be changed by a parameter other than the environment and the travel distance of the photosensitive member 2.

In the example graph illustrated in FIG. 8, if the background potential is 140 V, both of the background fog and the carrier adhesion can be prevented. Thus, when executing the process control, the controller 30 determines a target charging potential to obtain the background potential of 140 V and a desired development potential, for example. However, since a value of the charging bias Vc to obtain the charging potential Vd may be changed by various factors, the target charging potential may not always be obtained by the charging bias Vc determined by the process control. In some instances, an actual charging potential Vd may significantly differ from a target charging potential (e.g., 140 V in FIG. 8). In such a case, carrier adhesion may occur if the actual background potential exceeds 170 V, or background fog may occur if the actual background potential falls below 110 V in the graph illustrated in FIG. 8. A line 101 in the graph illustrated in FIG. 8 indicates 140 V.

Figure 9:
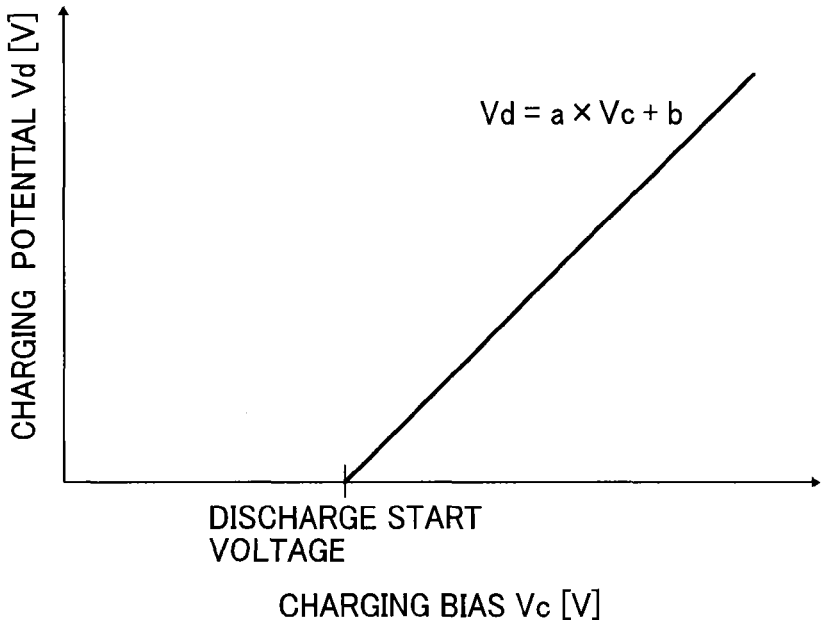
FIG. 9 is a graph of a relationship between a charging potential Vd and a charging bias Vc.

As described above, the charging roller 3 of a rubber roller receives the charging bias Vc. In a graph illustrated in FIG. 9, the charging potential Vd of the photosensitive member 2 has characteristics that are expressed by the equation as follows:

$$Vd=a\times Vc+b,$$

where "a" is a gradient of the graph of FIG. 9, and "b" is a Vd-axis intercept that is a negative value. In the graph illustrated in FIG. 9, a value of a Vc-axis intercept is substantially the same as that of a discharge start voltage between the charging roller 3 and the photosensitive member 2. The gradient "a" in the graph illustrated in FIG. 9 is approximately 1.

As described above, the printer 100 employs the contact DC charging method, by which a charging bias including only a DC component is applied to the charging roller 3 being in contact with the photosensitive member 2. Unlike a method using an AC/DC superimposed bias as the charging bias, the contact DC charging method does not need an AC power source, thereby reducing costs of the printer 100. On the other hand, since the contact DC charging method does not form an AC electric field between the charging roller 3 and the photosensitive member 2, the charging bias Vc needs to be increased to a value greater than that of the discharge start voltage illustrated in FIG. 9. This allows the discharge to occur between the charging roller 3 and the photosensitive member 2, otherwise the photosensitive members 2 cannot be charged. Even if the photosensitive member 2 could be charged, the charging potential Vd fluctuates under the same conditions of the charging bias Vc due to fluctuation of the discharge start voltage in response to environment, an abrasion rate of a surface of the photosensitive member 2, an electric resistance of the charging roller 3, and an amount of fog. Consequently, a desired charging potential Vd may not be easily and stably obtained by the contact DC charging method compared to the AC charging method.

Figure 10:
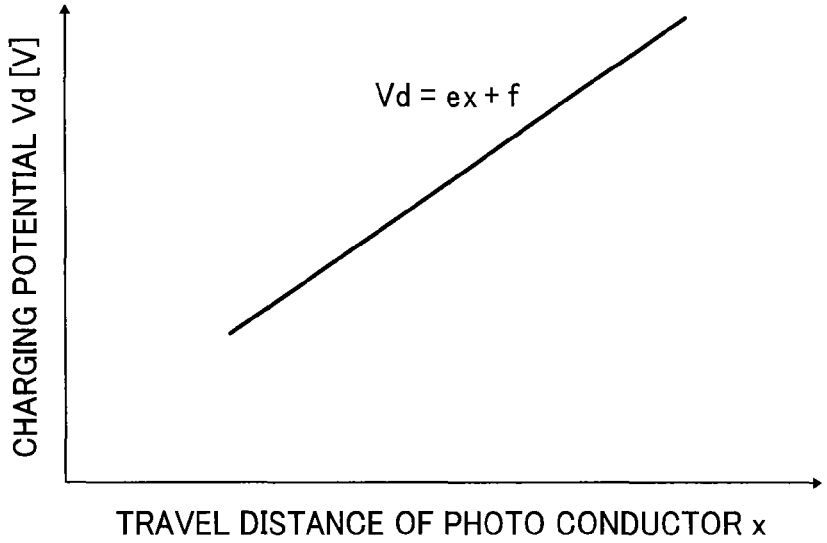
FIG. 10 is a graph of a relationship between a charging potential Vd and a travel distance x of a photosensitive member.

FIG. 10 is a graph of a relationship between a charging potential Vd and a travel distance x of the photosensitive member 2. The travel distance x is the cumulative movement distance of a surface of the photosensitive member 2 with the rotation of the photosensitive member 2. As illustrated in FIG. 10, the charging potential Vd has characteristics that are expressed by an equation as follows:

$$Vd=ex+f,$$

where "e" is a gradient of the graph illustrated in FIG. 10, and "f" is a Vd-axis intercept. Each of the gradient "e" and the intercept "f" is not a constant value. That is, each of the gradient "e" and the intercept "f" changes randomly over time. Since a cleaning blade and a developer contact and slide against a surface of the photosensitive member 2, the surface of the photosensitive member 2 is abraded over time. The abrasion increases the electrostatic capacity of the photosensitive member 2 over time. Meanwhile, an increase in the electric capacity of the photosensitive member 2 decreases a discharge start voltage, thereby increasing the charging potential Vd. The abrasion rate is further affected by various factors such as image area, image shape (e.g., a vertical band-shaped image formed in one area in a main scanning direction: in this case, an area of the photosensitive member 2 contacting the image undergoes abrasion), environment, and carrier adhesion amount. Moreover, a state of the fog caused by a toner additive or toner on a surface of the charging roller 3 changes randomly, and the discharge start voltage is changed accordingly. Therefore, each of the gradient "e" and the intercept "f" changes randomly over time. In addition to such changes, the abrasion rate of the surface of the photosensitive member 2 is not directly measured, causing difficulty in determining the charging potential Vd by using an arithmetic method.

On the other hand, in the electrophotographic process, an exposure amount (an amount of light to write a latent image) needs to be appropriately controlled to maintain consistent image density. If the exposure amount exceeds an optimum value, a diameter of a dot and a width of a line increase. In such a case, a shape of the image is deformed in a halftone area. On the other hand, if the exposure amount is smaller than the optimum value, a white spot may be generated in a highlight area.

Figure 11:
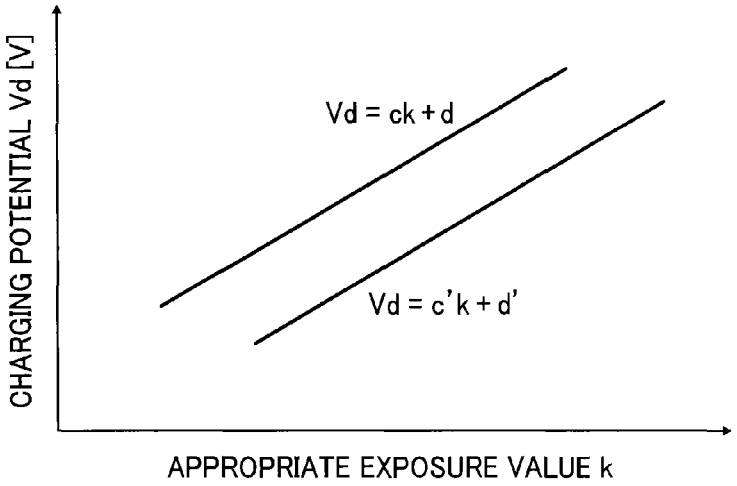
FIG. 11 is a graph of a relationship between a charging potential Vd and an appropriate exposure amount k.

FIG. 11 is a graph of a relationship between the charging potential Vd and an appropriate exposure amount k. When the photosensitive member 2 is in an initial state, the charging potential Vd has characteristics that are expressed as follows:

$$Vd=ck+d,$$

where "c" is a gradient of the graph illustrated in FIG. 11, and "d" is a Vd-axis intercept of the graph. If the exposure amount is constant, the charging potential Vd needs to be stabilized to obtain a desired image density. Moreover, a relationship between the charging potential Vd and the appropriate exposure amount k changes to the following equation as the photosensitive member 2 becomes older.

$$d=c+'K+d'$$

Accordingly, even when the exposure amount is maintained to be constant, the desired image density cannot be maintained.

Figure 12:
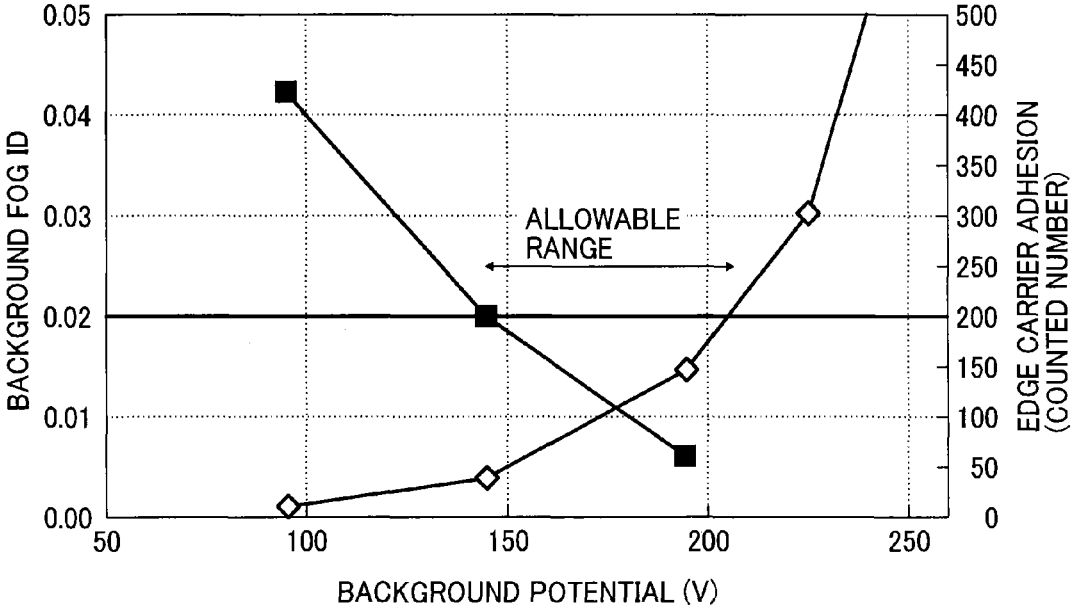
FIG. 12 is a graph of a relationship between a background fog ID, a background potential, and edge-carrier adhesion (a carrier adhesion amount with respect to the photosensitive member)

FIG. 12 is a graph of a relationship between a background fog image density (ID), a background potential, and edge-carrier adhesion (an amount of carrier adhering to the photosensitive member 2). The background fog ID indicates a measurement value of image density. The image density is acquired by transferring toner in a background area of the photosensitive member 2 to adhesive tape and measuring the amount of transferred toner on the adhesive tape. The edge carrier adhesion indicates a value acquired by counting the number of magnetic carrier particles that have adhered to an area near an edge of an image on the photosensitive member 2 when a special image containing many areas with enhanced edges is output. In the graph illustrated in FIG. 12, a straight line indicates a target value, a line with black squares indicates the background fog, and a line with white rhombuses indicates the edge carrier adhesion. As illustrated in FIG. 12, the lower the background potential, the higher the background fog ID. The higher the background potential, the higher the edge carrier adhesion. In FIG. 12, an optimum value of the background potential is approximately 180 V, and the background potential needs to be within ±30 V from this optimum value to prevent both background fog and the carrier adhesion. Although this optimum value may vary depending on the model of the printer 100, there is not a significant difference in optimum values among similar models.

Accordingly, after executing the process control, the controller 30 performs a charging bias adjustment control as necessary to adjust the charging bias Vc such that a target charging potential is obtained.

Figure 13:
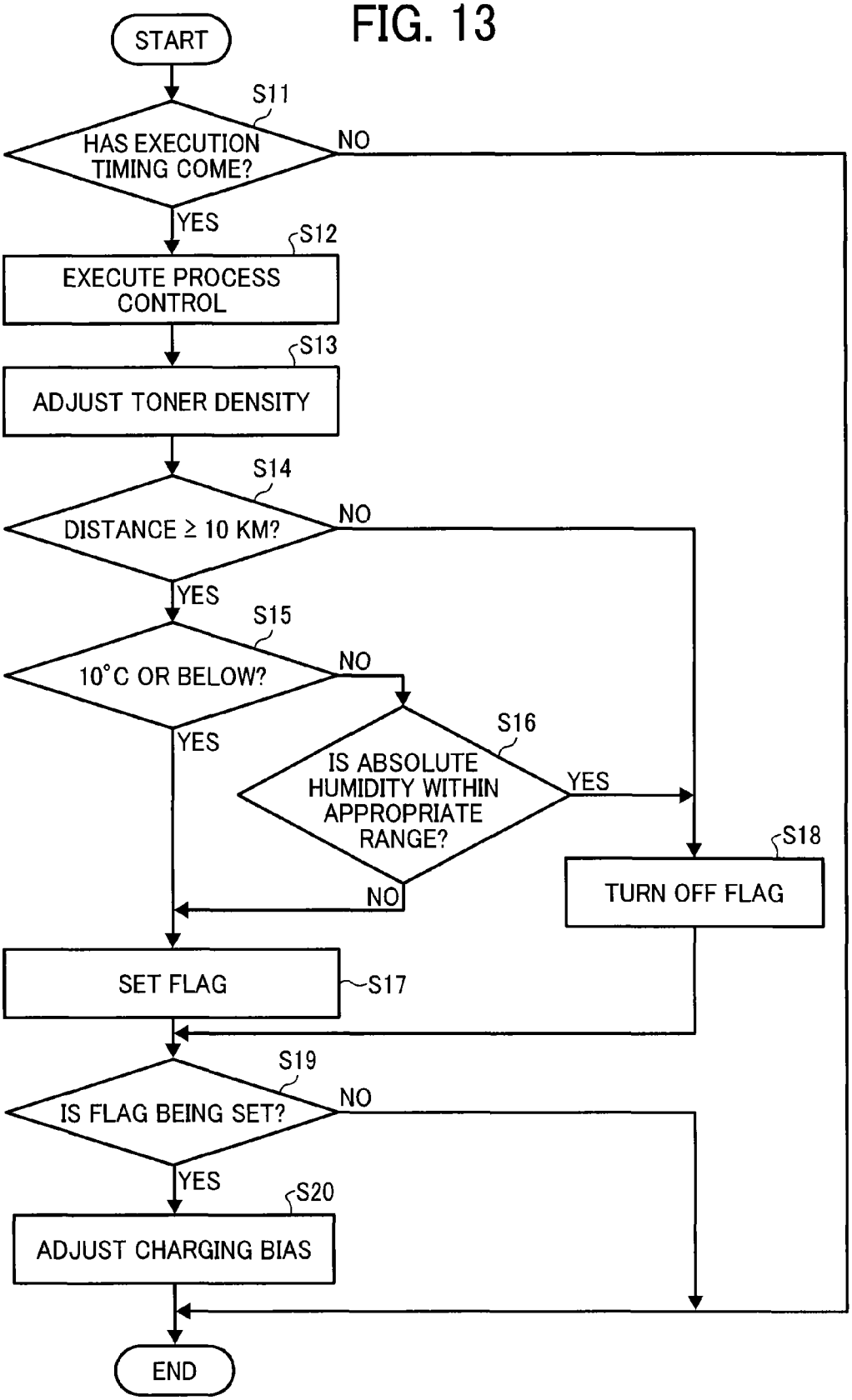
FIG. 13 is a flowchart of a regular routine process executed by a controller of the printer.

FIG. 13 is a flowchart of a regular routine process executed by the controller 30. In step S11, the controller 30 determines whether execution timing of the process control has come. If the execution timing has not come yet (NO in step S11), the regular routine process ends immediately. On the other hand, if the execution timing has come (YES in step S11), the process proceeds to step S12.

In step S12, the controller 30 executes the process control described above. In a case where the printer 100 is executing a continuous printing operation, the controller 30 temporarily stops the continuous printing operation before starting the process control.

When the controller 30 finishes the process control, the process proceeds to step S13. In step S13, the controller 30 executes a toner density adjustment process to adjust a toner density of the developer stored in each of the development devices 4Y, 4C, 4M, and 4K. In some instances, since the target toner density may be changed in the process control in some instances, the controller 30 adjusts the toner density after finishing the process control. If the current toner density is lower than the target toner density, the controller 30 allows toner to be supplied to the developer. If the current toner density is higher than the target toner density, the controller 30 allows toner to be forcibly used by developing toner images as needed.

When finishing the toner density adjustment process, the controller 30 determines whether a charging bias adjustment control is necessary. The inventors have found that the target charging potential determined by the process control and the actual charging potential Vd begin to differ from each other when a travel distance of the photosensitive member 2 reaches a threshold value. On the other hand, the inventors have found that the difference between the target charging potential and the actual charging potential Vd is barely generated when the travel distance of the photosensitive member 2 has not yet reached the threshold value. Thus, in step S14, the controller 30 determines whether the cumulative travel distance of the photosensitive member 2 is 10 km (threshold value) or greater. If the travel distance of the photosensitive member 2 is less than the threshold value (NO in step S14), the process proceeds to step S18 in which the controller 30 turns off a determination flag. Subsequently, in step S19, the controller 30 determines whether that the flag is being set. If the flag is not being set (i.e., the toner density adjustment process is not necessary) (NO in step S19). Then, the regular routine process ends.

The inventors have also found that even if the travel distance of the photosensitive member 2 has readied the threshold value, the difference between the target charging potential and the actual charging potential Vd may be relatively small, depending on environment. For example, if temperature is at or below a threshold value, the difference between the target charging potential and the actual charging potential Vd is greater. Hence, the controller 30 needs to execute the charging bias adjustment process. However, even if the temperature exceeds the threshold value, the difference may be increased due to an extremely low or high absolute humidity. In such a case, the controller 30 needs to execute the charging bias adjustment process. In the other cases, the difference between the target charging potential and the actual charging potential Vd is relatively small, and thus the charging bias adjustment process may not be needed.

If the travel distance of the photosensitive member 2 exceeds 10 km (YES in step S14), the process proceeds to step S15 in which the controller 30 determines whether a temperature is 10° C. (a threshold value) or below. If the temperature is 10° C. or below (YES in step S15), the process proceeds to step S17 in which the controller 30 sets the determination flag. Subsequently, the controller 30 determines that the flag is being set (YES in step S19). In step S20, the controller 30 executes the charging bias adjustment control. On the other hand, if the temperature is not 10° C. or below (NO in step S15), the process proceeds to step S16 in which the controller 30 determines whether an absolute humidity is within an appropriate range. For example, the controller 30 determines whether the absolute humidity is higher than 5 mg/m$^3$ and lower than 18 mg/m$^3$ (within an appropriate range). If the absolute humidity is not within the appropriate range (NO in step S16), the controller 30 executes step S17 and step S19 described above. Then, in step S20, the controller 30 executes the charging bias adjustment control. On the other hand, if the absolute humidity is within the appropriate range (YES in step S16), the controller 30 executes step S18 and step S19 described above. Then, the regular routine process ends without the charging bias adjustment control.

Therefore, the controller 30 determines execution timing of the charging bias adjustment control based on the travel distance of the photosensitive member 2 and the detection result (temperature and humidity) acquired by the environment sensor 52. This prevents execution of unnecessary charging bias adjustment control, thereby reducing downtime of the printer 100. Upon execution of the charging bias adjustment control, the controller 30 may finish the regular routine process after executing the toner density adjustment process again.

In the charging bias adjustment control, the controller 30 executes the following process for each color, so that a background fog pattern of each color is formed on the intermediate transfer belt 7.

First, when the photosensitive member 2 is driven with the optical writing unit 6 being stopped, the charging bias Vc is gradually changed. This forms a plurality of sections each having a different charging potential Vd in a circumferential direction of the surface of the photosensitive member 2. With the rotation of the photosensitive member 2, each of the sections passes a development position to form a background fog pattern including the plurality of sections on the surface of the photosensitive member 2. Each of the plurality of sections has a different amount of the background fog (each of different background potentials acts). Subsequently, the background fog pattern is primarily transferred to the intermediate transfer belt 7. The background fog pattern of each color is primarily transferred to a front surface of the intermediate transfer belt 7 such that the background fog patterns do not overlap in a travel direction.

Figure 14:
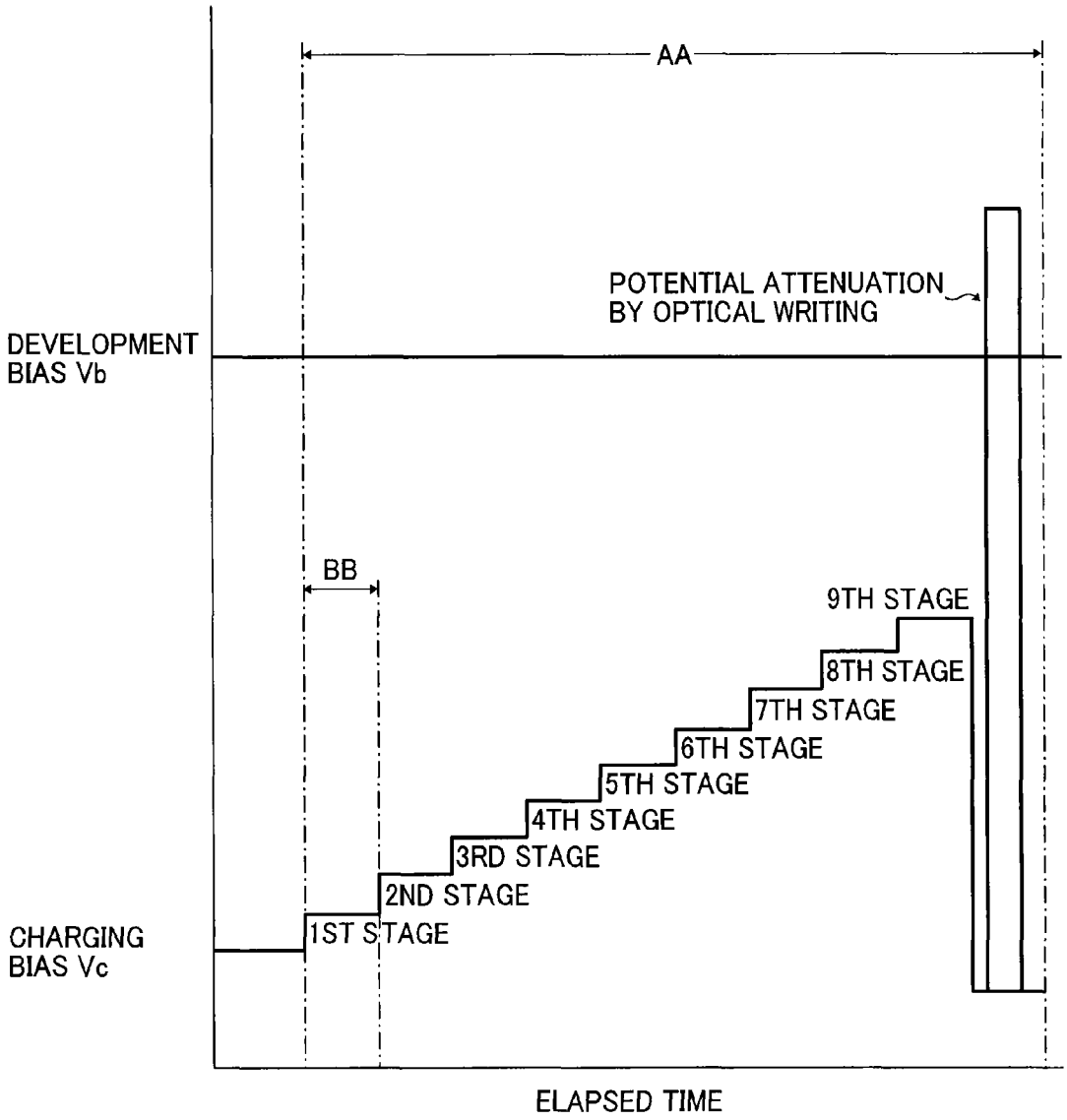
FIG. 14 is a graph of a change in each potential over time when an image forming unit for yellow forms a background fog pattern.

FIG. 14 is a graph of changes in each potential over time when the image forming unit 1Y forms a background fog pattern. As illustrated in FIG. 14, when a Y background fog pattern is formed, the controller 30 gradually changes the charging bias Vc with the development bias Vb held constant. Since the printer 100 uses the development bias Vb and the charging bias Vc each having a negative polarity, the graph illustrated in FIG. 14 indicates that the lower the position in the graph, the greater the absolute value of the bias. In FIG. 14, a time AA indicates a time needed for the surface of the photosensitive member 2 to move a distance of 100 mm, whereas a time BB indicates a time needed for the surface of the photosensitive member 2 to move a distance of 10 mm. There is a distance of 100 mm between two stations. In FIG. 14, the charging bias Vc is changed in nine stages. For example, in a first stage, a DC bias of 1330−V is output as the charging bias Vc. In each of subsequent stages, an absolute value of the charging bias Vc is reduced by 20 V whenever time corresponding to 10 mm of a travel distance of the photosensitive member 2 elapses. That is, absolute values of the charging bias Vc in a second stage and a third stage are 1330−V and 1310−V, respectively.

The Y background fog pattern formed on the front surface of the photosensitive member 2Y is transferred to a front surface of the intermediate transfer belt 7 in the primary transfer nip. Similarly, background fog patterns of the other colors are formed and transferred to the front surface of the intermediate transfer belt 7.

While forming the background fog pattern, the controller 30 acquires and stores outputs from the corresponding reflective photo sensor 20*a*, 20*b*, 20*c*, or 20*d* when the background fog pattern on the intermediate transfer belt 7 enters a position (a detection range) opposite the optical sensor unit 20. The controller 30 acquires a toner adhesion amount (an amount of toner on the background fog, and also called a background fog toner amount) with respect to each section based on an average output value. Then, the controller 30 specifies a charging bias Vc that allows the background fog ID to be provided in an allowable range, based on the background fog toner amount of each section and the charging bias Vc of each section corresponding to the background fog toner amount. The controller 30 determines a charging bias correction value based on the specified charging bias Vc. Subsequently, the controller 30 shifts the charging bias Vc by an amount of the charging bias correction value to update a setting value of the charging bias Vc to be used for normal printing. Accordingly, the surface of the photosensitive member 2 is charged with a substantially target charging potential to secure a desired background potential, thereby suppressing the background fog and the carrier adhesion.

In the normal printing, the controller 30 transmits a command signal for outputting the charging bias Vc to a charging power source unit 50 serving as a charging power source. Herein, the controller 30 transmits the command signal according to the setting value of the charging bias Vc. This enables the charging power source unit 50 to output an amount of the charging bias Vc substantially the same as the setting value. The charging power source unit 50 can output a different amount of the charging bias Vc for each of the charging rollers 3Y, 3C, 3M and 3K.

Figure 15:
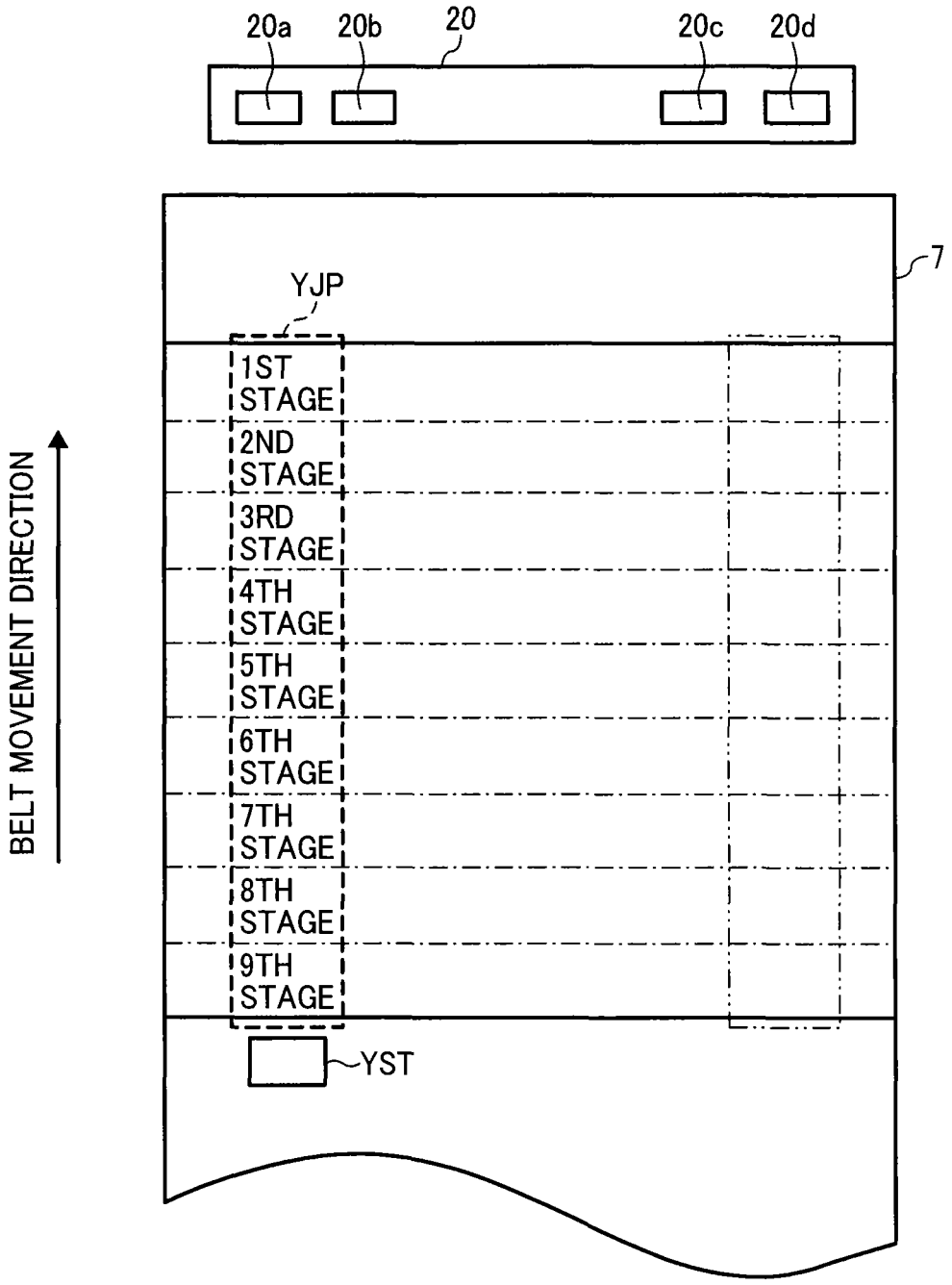
FIG. 15 is a schematic plan view of a yellow background fog pattern transferred to the intermediate transfer belt of the printer.

FIG. 15 is a schematic plan view of a yellow background fog pattern YJP (hereinafter called a background fog pattern YJP) transferred to the intermediate transfer belt 7. In FIG. 15, a dashed line is drawn as a boundary of each section of the background fog pattern YJP for the sake of convenience. A background fog pattern may not necessarily be formed across a belt width direction. The background fog pattern needs to be formed only in an area that is detected by the reflective photo sensor 20*a*, 20*b*, 20*c*, or 20*d*. As for an area that is not detected by the reflective photo sensor 20*a*, 20*b*, 20*c*, or 20*d*, since a background area is not necessarily maintained as is, a toner image may be formed. In FIG. 15, the background fog adheres across the belt width direction. In FIG. 15, a toner image is not formed on the intermediate transfer belt 7 for a sake of convenience, and a dotted line is drawn in only a certain area in the belt direction to distinguish an area of the background fog pattern from the other areas. This distinguished area is illustrated as the background fog pattern YJP. In particular, the printer 100 uses the first reflective photo sensor 20*a* out of the four reflective photo sensors 20*a*, 20*b*, 20*c*, and 20*d* to detect a background fog toner amount. Hence, an area that passes directly below the first reflective photo sensor 20*a* is illustrated as the background fog pattern YJP with the dotted line in FIG. 15. However, the fourth reflective photo sensor 20*d* may detect an amount of toner on the background fog pattern YJP. In such a case, the background fog pattern YJP is provided in an area indicated by a two-dot chain line, instead of the area with the dotted line.

As illustrated in FIG. 15, the printer 100 forms a yellow toner image YST used to identify a position (hereinafter called a toner image used for position identification YST). The toner image used for position identification YST is an electrostatic latent image formed immediately after the background fog pattern YJP. As illustrated in FIG. 15, after the charging bias Vc of the ninth stage is output, optical writing is performed on an area of the photosensitive member 2 to form the toner image used for position identification YST, the area having an absolute value of the charging bias Vc greater than that of the first stage.

The controller 30 starts actual sampling slightly earlier than theoretical timing (a predetermined clock value) would predict when the background fog pattern YJP illustrated in FIG. 15 enters a position (a detection range) immediately below the first reflective photo sensor 20*a*. In the sampling process, output values of the first reflective photo sensor 20*a* are sampled at short time intervals, and the resultant values are stored. The controller 30 stores time at which an output value of the optical sensor unit 20 has changed significantly as the time when the toner image used for position identification YST has entered a position immediately below the first reflective photo sensor 20*a*, and finishes the sampling process. Moreover, the controller 30 groups the sampling data on a time-series basis to form sampling data groups for the respective sections of the background fog pattern YJP. Accordingly, generation of the sampling data groups can identify a time when each of the sections enters the detection range.

After generation of the sampling data groups for the respective sections, the controller 30 determines a toner adhesion amount of each of the sections based on an average of the sampling data.

In addition to the background fog pattern YJP, the similar process is performed with respect to each of the C, M and K background fog patterns. That is, toner image used for position identifications are formed immediately after the C, M and K background fog patterns, and the printer 100 forms sampling data groups for respective sections based on detected timing of the toner image used for position identifications. As for the Y, C, and M colors, a background fog pattern may be formed in any position in the belt width direction as long as the background fog pattern can be detected by any of the first reflective photo sensor 20*a*, the second reflective photo sensor 20*b*, and the fourth reflective photo sensor 20*d*. However, the printer 100 forms a background fog pattern in a position that can be detected by the first reflective photo sensor 20*a* or the fourth reflective photo sensor 20*d* for the reason described below.

Moreover, a background fog pattern for K may be formed in any position in the belt width direction as long as the K background fog pattern can be detected by any of the four reflective photo sensors 20*a*, 20*b*, 20*c*, and 20*d*. Even if the first reflective photo sensor 20*a*, the second reflective photo sensor 20*b*, or the fourth reflective photo sensor 20*d* is used, the controller 30 can accurately determine a K-toner adhesion amount by using output values of only a regular reflection light. However, the printer 100 forms the K background fog pattern in a position that can be detected by the first reflective photo sensor 20*a* or the fourth reflective photo sensor 20*d* for the reason described below.

In the printer 100, the toner image used for position identification YST facilitates transfer of toner to an electrostatic latent image with development potential. When the toner image used for position identification YST enters a detection position of the reflective photo sensor 20*a*, an output value of the reflective photo sensor 20*a* significantly changes. Thus, the controller 30, based on the change in the output value of the reflective photo sensor 20*a*, can accurately measure time at which the toner image used for position identification YST has entered the detection range. There is a difference between the time when the toner image used for position identification YST has entered the detection range and a time when each section in the background fog pattern enters the detection range. This time difference is much smaller than that between a time when the charging bias Vc has begun to change gradually to form the background fog pattern and a time when each section of the background fog pattern enters the detection range. The reduction in the time difference enables the controller 30 to accurately identify the time when each section enters the detection range, unlike a case where the time when the charging bias Vc has begun to change gradually is used as a reference to identify the time when each section enters a detection range. Therefore, the printer 100 can prevent background fog and carrier adhesion caused by poor accuracy in identifying a time when each section of a background fog pattern enters a detection range.

In the printer 100, a distance between stations is set to 100 mm as illustrated in FIG. 14. This distance represents an arrangement pitch of two of the image forming units 1C, 1M, and 1K arranged adjacent to each other in the belt movement direction. Moreover, the distance between the adjacent stations is substantially the same as that between adjacent primary transfer nips. In the belt movement direction, a distance from a leading end of a background fog pattern to a trailing end of a toner image used for position identification is less than the distance (100 mm) between the stations. This prevents the background fog patterns from being overlapped one another although the background fog patterns of all the colors are formed within the same area in the belt width direction. Moreover, the printer 100 can start forming each of the background fog patterns at substantially the same time, thereby shortening execution time of the charging bias adjustment control.

Figure 16:
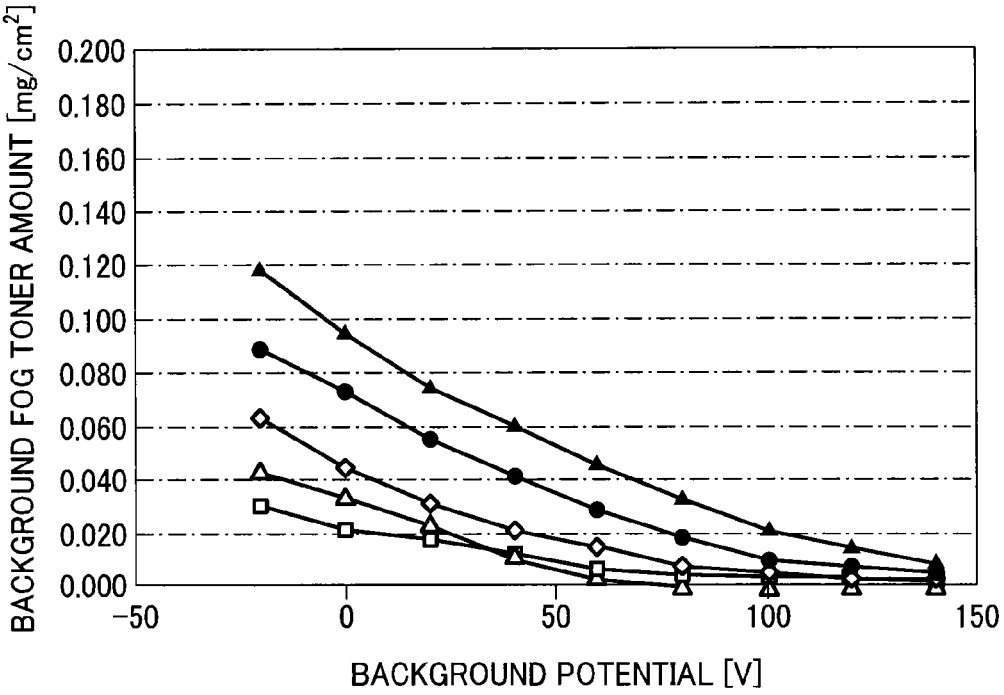
FIG. 16 is a graph of a relationship between a background fog toner amount and a background potential of each section of the background fog pattern.

FIG. 16 is a graph of a relationship between an amount of toner on background fog and a background potential of each section of a background fog pattern. In the graph illustrated in FIG. 16, a plurality of lines contains plotted points with shapes that differ from one line to another. These lines indicate characteristics based on results of experiments performed by image forming units having different travel distances on photosensitive members.

As illustrated in FIG. 16, the characteristics differed markedly from one another depending on the image forming units. In the image forming unit with the characteristics indicated by the first line from the top of the graph illustrated in FIG. 16 (the line with black triangle plotted points), an amount of toner on background fog was relatively large, whereas a background potential was a relatively small. It is conceivable that this image forming unit generated the background fog more easily due a decrease in a toner charge amount (Q/M) to a relatively low level caused by deterioration in developer, or a decrease in a charging potential Vd to a level lower than a target charging potential caused by an increase in a discharge start voltage to a relatively high level. Such an image forming unit needed to prevent the background fog by increasing an actual charging potential Vd by adjusting a charging bias Vc to a larger value (since the charging bias Vc is a negative bias, an absolute value thereof should be increased to a larger value).

On the other hand, in the image forming unit with the characteristics indicated by the line with white square plotted points in FIG. 16, an amount of toner on background fog was relatively small although a background potential was relatively large. Accordingly, it is conceivable that this image forming unit allowed carrier adhesion to occur more easily due to an increase in a charging potential Vd to a level higher than a target charge potential caused by a decrease in a discharge start voltage to a relatively low level. Such an image forming unit needed to prevent carrier adhesion by decreasing an actual charging potential Vd by adjusting the charging bias Vc to a smaller value (since the charging bias Vc is a negative bias, an absolute value thereof should be a smaller value).

Figure 17:
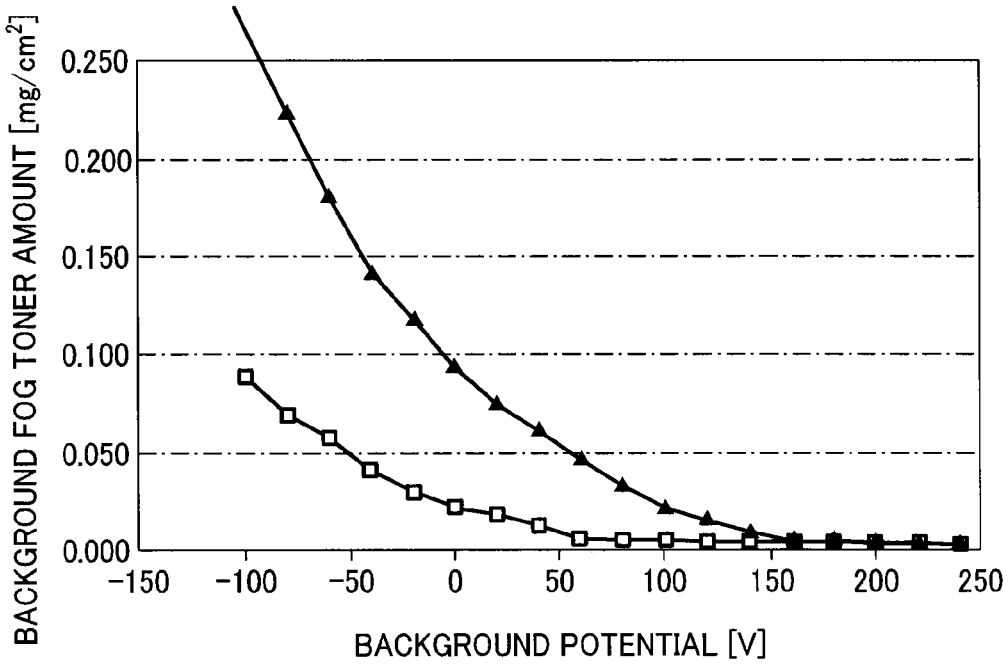
FIG. 17 is a graph of a relationship between a characteristic curve of a background fog toner amount and the background potential, and a gradient of a straight-line approximation thereof.

FIG. 17 is a graph of a relationship between a characteristic curve and a gradient of a straight-line approximation thereof, the characteristic curve indicating a relationship between an amount of toner on background fog and a background potential. In FIG. 17, there are two characteristic curves. Each of the curves is formed by connecting all of plotted points with respect to an image forming unit that has acquired experiment data. When a charging bias correction value is determined, such characteristic curves should not be used. A straight-line approximation of the characteristics needs to be determined to determine the charging bias correction value. As described below, within the straight-line approximation, only an area in which an amount of toner on background fog is moderate is used. Hence, the straight line-approximation needs to have a suitable gradient in the area in which a background fog toner amount is moderate (hereinafter called a moderate adhesion area). However, in a case where a characteristic curve on the whole is provided in an area in which a background fog toner amount is relatively high (hereinafter called a high adhesion area) as the upper characteristic curve in FIG. 17, the characteristic curve rises on a high adhesion amount side. This causes the straight-line approximation to have a gradient greater than an optimum value in the moderate adhesion area. Moreover, in a case where a characteristic curve on the whole is provided in an area in which the background fog toner amount is relatively low (hereinafter called a low adhesion area) as the lower characteristic curve in FIG. 17, the characteristic curve lies on a low adhesion amount side. This causes the straight-line approximation to have a gradient smaller than an optimum value in the moderate adhesion area.

Accordingly, the controller 30 extracts sampling data for a sampling data group corresponding to each section of a background fog pattern. Herein, the controller 30 extracts only the sampling data with a background fog toner amount that is within a range from a predetermined lower limit to a predetermined upper limit. The controller 30 determines an approximate straight line based on an extracted data group containing only the extracted sampling data. If the number of extracted sampling data is two or less, the controller 30 cannot determine a straight-line approximation. Thus, the charging bias adjustment process ends.

Figure 18:
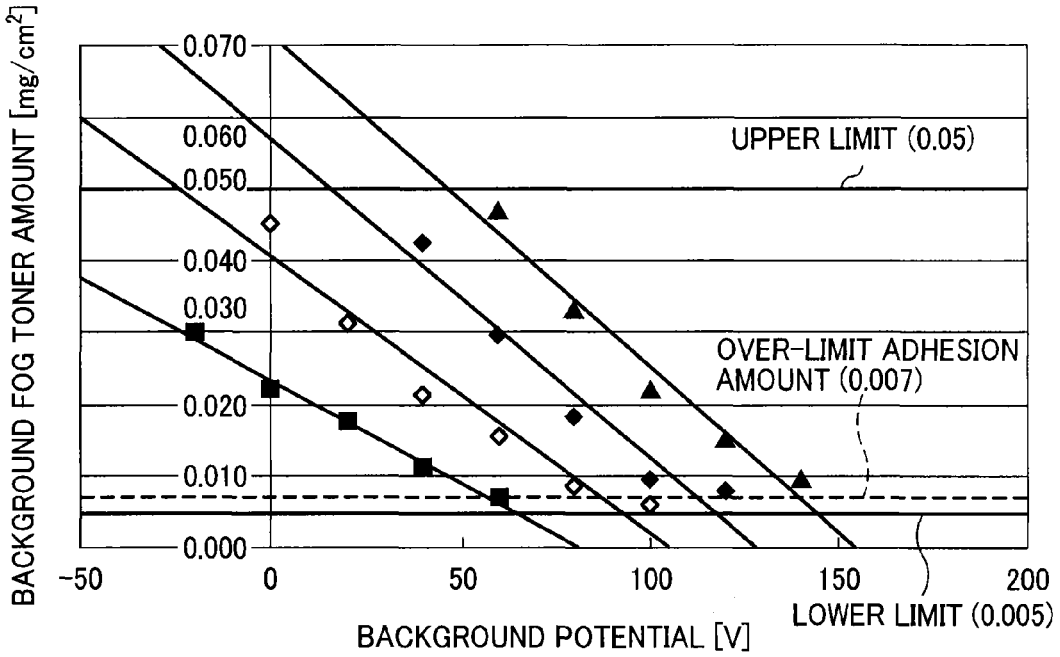
FIG. 18 is a graph of a relationship between a straight-line approximation and an extracted data group.

FIG. 18 is a graph of a relationship between a straight-line approximation and an extracted data group. In FIG. 18, there are four approximation strait lines determined based on four extracted data groups. As illustrated in FIG. 18, in any extracted data group (a set of plotted points having the same shape), a background fog toner amount of sampling data is provided within a range from a lower limit to an upper limit. The printer 100 uses 0.005 mg/cm$^2$ as the lower limit, and 0.05 mg/cm$^2$ as the upper limit.

After determining the straight-line approximation, the controller 30 specifies a background potential that allows the straight-line approximation to meet an over-limit adhesion amount as an over-limit background potential P1. The over-limit adhesion amount is slightly higher than a background fog toner amount that enables an image density of background fog to barely remain in an allowable range. The over-limit adhesion amount is a constant defined beforehand experimentally, and serves as a value between a lower limit and an upper limit. In other words, the lower limit and the upper limit are defined such that the over-limit adhesion amount is set between the lower limit and the upper limit. The printer 100 uses 0.007 mg/cm$^2$ as the over-limit adhesion amount.

Upon determination of the over-limit background potential P1, the controller 30 determines a charging bias correction amount β according to an equation as follows:

$$\beta = P1 - (P2 - S1),$$

where P2 is a theoretical value of the background potential used in the process control, and S1 is a predetermined amount of margin. The margin S1 is a constant defined beforehand experimentally. Subtraction of the margin S1 from the theoretical background-potential value P2 results in a theoretical over-limit potential. This theoretical over-limit potential is a background potential that allows an over-limit adhesion amount to be obtained in the condition where the theoretical background-potential value P2 is used. In other words, subtraction of the margin S1 from the over-limit background potential P1 results in a practical background potential that allows a background fog toner amount to be reliably set in the allowance range. With the above equation, the charging bias correction amount β as an appropriate correction amount for the charging bias Vc is determined by subtracting the theoretical over-limit potential from the over-limit background potential P1 so that the charging potential Vd is set to a substantially target charging potential.

The printer 100 uses 90 V as the margin S1. Accordingly, for example, if the theoretical background-potential value P2, the margin S1, and the over-limit background potential P1 are 160 V, 90 V, and 139 V, respectively, the charging bias correction amount β is determined as follows:

$$\beta=139-(160-90)=69$$

In the printer 100, an upper limit of the charging bias correction amount β is set to 50 V. If a calculation of the charging bias correction amount β is greater than 50 V for example, 69 V as the described above, the charging bias correction amount β is corrected to 50 V, which is the same as the upper limit.

Upon determination of the charging bias correction amount β, the controller 30 subtracts the charging bias correction amount β from the charging bias Vc determined by the process control to correct the charging bias Vc to a value such that the charging potential Vd is set to a substantially target charging potential. If the charging bias correction amount β is a positive value, the charging bias Vc is corrected to a greater value on a negative side. Such correction increases an actual background potential, thereby suppressing background fog. On the other hand, if the charging bias correction amount β is a negative value, the controller 30 corrects the charging bias Vc to a value (a value with a smaller absolute value) that is obtained by shifting the charging bias Vc to the positive side by an amount of an absolute value of the charging bias correction amount β. Therefore, the actual background potential becomes smaller, thereby suppressing carrier adhesion. Where the charging bias correction amount β becomes a negative value, the upper limit of the absolute value thereof is set to 50. Thus, for example, if the charging bias correction amount β is determined as "−69 V", the controller 30 corrects the charging bias Vc to a value that is obtained by shifting the charging bias Vc to the positive side by 50 V.

In the printer 100, as described above, the controller 30 determines the charging bias correction amount β. That is, the printer 100 calculates a straight-line approximation based on only the sampling data between the lower limit and the upper limit, and sets an over-limit adhesion amount between the lower limit and the upper limit. Then, the controller 30 determines the charging bias correction amount β based on the over-limit background potential P1, the theoretical background-potential value P2, and the margin S1. In such a configuration, even if all coordinate values of the background fog toner amounts of the sampling data exceed an allowable range of the background fog ID, the controller 30 can determine the charging bias correction amount β which allows all the coordinate values to be in the allowable range. Therefore, the printer 100 can form a background fog pattern without increasing a background potential to a value where carrier adhesion occurs, thereby preventing the carrier adhesion from occurring when the background fog is formed.

Figure 19:
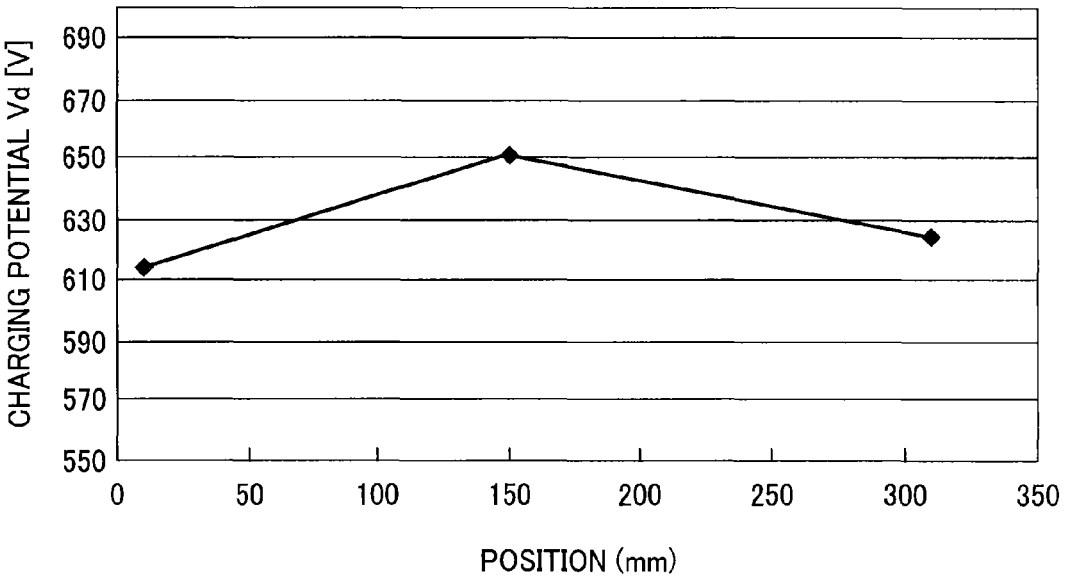
FIG. 19 is a graph of a relationship between a charging potential Vd in a photosensitive member having a certain travel distance and a position in an axial direction of the photosensitive member.

FIG. 19 is a graph of a relationship between a charging potential Vd in the photosensitive member 2 having a certain travel distance and a position in an axial direction of the photosensitive member 2. The graph illustrated in FIG. 19 was prepared based on measurements of the charging potential Vd. The charging potential Vd was measured by reflective photo sensors arranged in a 10-mm position, a 160-mm position, and a 310-mm position in image forming width of 320 mm with respect to an A3-size image width of 300 mm. In the axial direction of the photosensitive member 2, the charging potential Vd was lower in edge areas than a middle area, that is, background fog occurred more easily in the edge areas.

Figure 20:
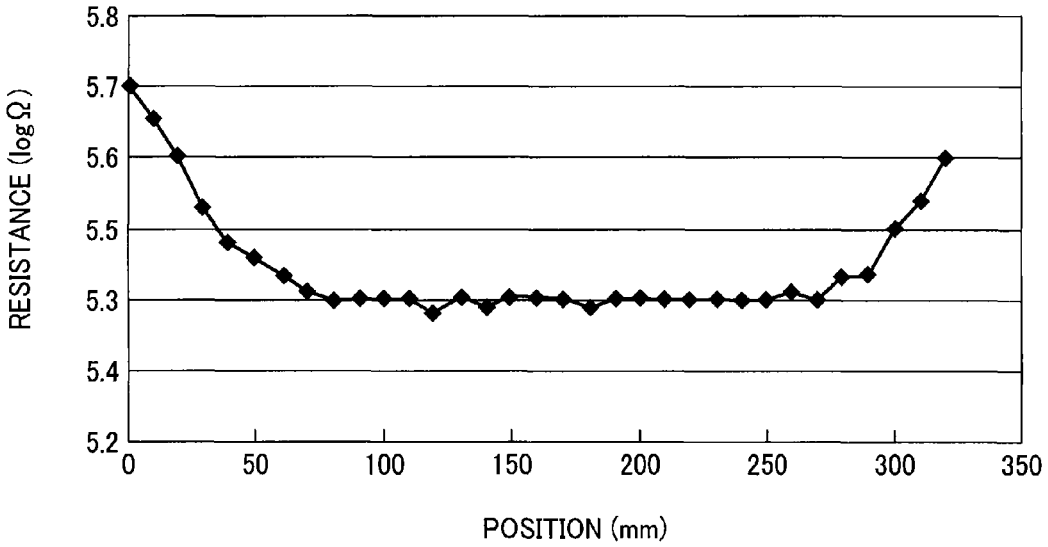
FIG. 20 is a graph of a relationship between an electric resistance of a charging roller in an image forming unit including a photosensitive member having a certain travel distance and a position in an axial direction of the charging roller.

FIG. 20 is a graph of a relationship between an electric resistance of the charging roller 3 of the image forming unit 1 including the photosensitive member 2 with a certain travel distance and a position in an axial direction of the charging roller 3. When a travel distance of the photosensitive member 2 was increased to some extent, edge areas in an axial direction of the charging roller 3 were soiled with silica (a toner additive). Hence, the electric resistance of the charging roller 3 was higher in the edge area than a middle area. This generated deviation in the charging potential Vd in a 10-mm position, a 160-mm position, and a 310-mm position of the photosensitive member 2.

Thus, the printer 100 forms combinations of background fog patterns and respective toner image used for position identifications for Y, C, M and K in an edge area in a belt width direction corresponding to an edge area of the photosensitive member 2 or the charging roller 3. In particular, the combination of the background fog pattern and the toner image used for position identification for each color is formed in one edge area in the belt width direction corresponding to the first reflective photo sensor 20*a* or in the other edge area in the belt with direction corresponding to the fourth reflective photo sensor 20*d*. This enables the background fog to be sensitively detected.

Such a combination of the background fog pattern and the toner image used for position identification for each color may be desirably formed in both of edge areas in the belt width direction. Then, a toner adhesion amount of each section of the background fog pattern may be desirably detected in both of the edge areas to determine an average value thereof. In this way, the controller 30 can determine a more appropriate charging bias correction amount β.

As illustrated in FIG. 14, when the printer 100 forms a background fog pattern, the charging bias Vc is gradually increased. This indicates that the charging bias Vc is gradually changed from a value having a larger absolute value to a value having a smaller absolute value (since the charging bias Vc has a negative polarity, the smaller the value of the charging bias Vc, the larger the absolute value), while the background potential is gradually decreased. That is, when the printer 100 forms the background fog pattern, a plurality of sections is thrilled on the photosensitive member 2 in ascending order of background fog toner amounts according to the charging bias Vc setting. In a case where background fog occurs, a little amount of toner in the developer is consumed, causing a decrease in toner density. Since the printer 100 forms the plurality of sections on the photosensitive member 2 in ascending order of background fog toner amounts, the toner density is decreased little by little in the course of formation of the background fog pattern from a leading end to a trailing end. Therefore, the printer 100 can prevent a background fog toner amount from being inappropriate to each section due to a decrease in toner density, thereby detecting characteristics of background fog with higher accuracy. Moreover, the printer 100 forms a toner image used for position identification, which consumes a larger amount of toner, on a rear side relative to a background fog pattern in a belt movement direction, so that the toner image used for position identification is developed subsequent to development of a trailing end of the background fog pattern. Therefore, the printer 100 can prevent a decrease in detection accuracy of background fog characteristics due to a decrease in toner density caused by development of the toner image used for position identification.

Figure 21:
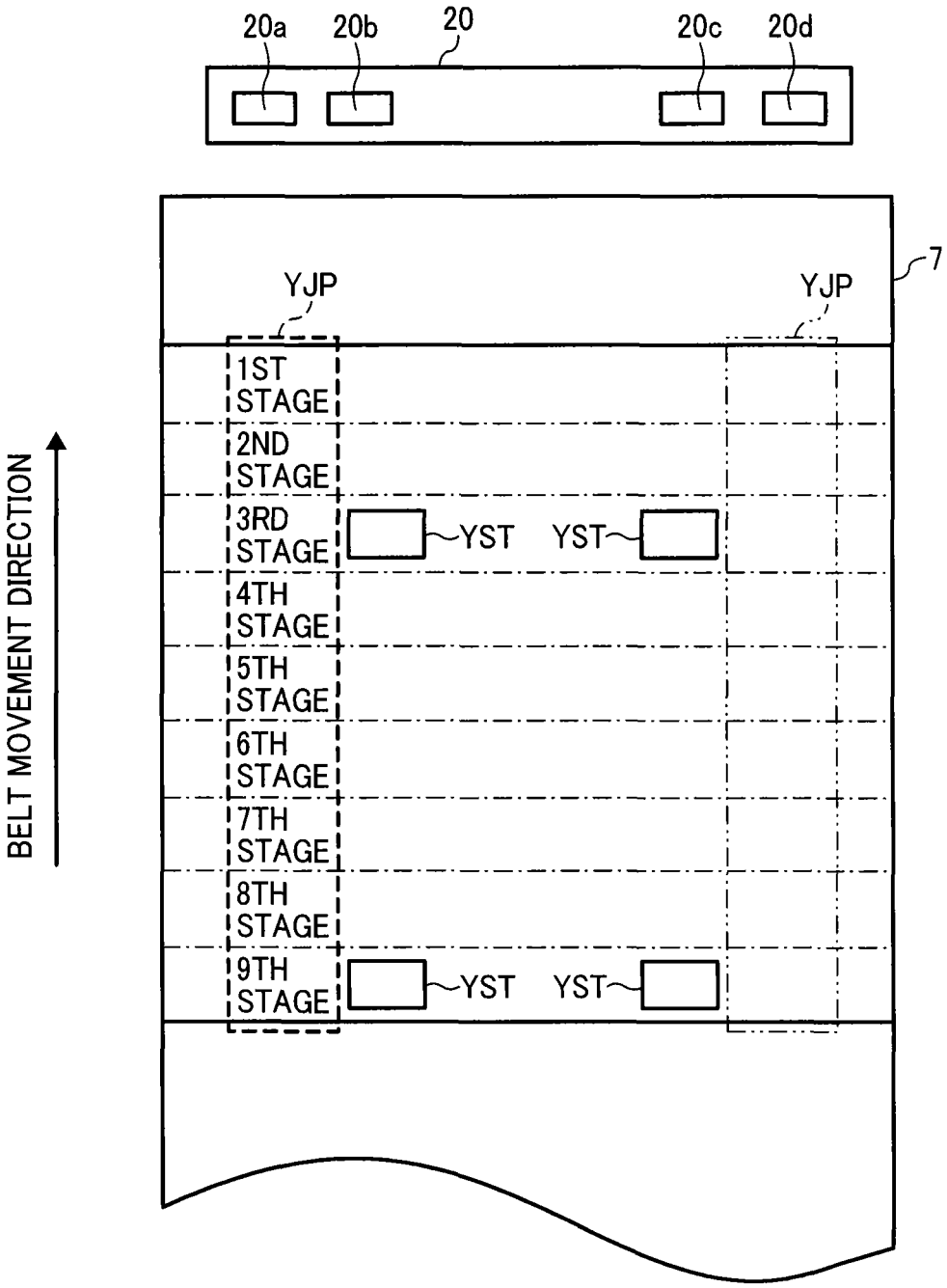
FIG. 21 is a schematic plan view of a modification example of a yellow background fog pattern transferred to the intermediate transfer belt of the printer.

The toner image used for position identification may not necessarily be formed on a front or rear side relative to the background fog pattern in a belt movement direction. For example, as illustrated in FIG. 21, a yellow toner image used for position identification YST may be formed next to a yellow background fog pattern YJP in a belt width direction. In FIG. 21, the toner image used for position identification YST is formed next to the background fog pattern YJP which is formed in one end area in the belt width direction to pass a detection range of the first reflective photo sensor 20*a*. The printer 100 determines, based on a time when the toner image used for position identification YST has entered a detection range of the second reflective photo sensor 20*b*, a time when each section of the background stain pattern YJP formed on one end area enters the detection range of the first reflective photo sensor 20*a*. Moreover, the printer 100 determine a time when each section of a background fog pattern YJP formed on the other end area enters a detection range of the fourth reflective photo sensor 20*d*. According to such a configuration, the printer 100 can determine a time when each section enters a detection range with higher accuracy. Moreover, the above image forming method can prevent background fog and carrier adhesion caused by poor accuracy in identifying a time when each section of a background fog pattern enters a detection range.

The printer 100 has been described using an example case in which the printer 100 gradually changes the charging bias Vc with the development bias Vb held constant when a background fog pattern is formed. Alternatively, the printer 100 may gradually change the development bias Vb with the charging bias Vc held constant.

The above description of the printer 100 is merely one example. The printer 100 serving as an image forming apparatus can provide effects in aspects below.

[Aspect A]

An image forming apparatus includes a latent image bearing member (e.g., a photosensitive member 2Y), a charging unit (e.g., a charging roller 3Y), a charging power source (e.g., a charging power source unit 50), a latent image wiring unit (e.g., an optical writing unit 6), a development unit (e.g., a development device 4Y), a transfer unit (e.g., an intermediate transfer unit 8), a toner detector (e.g., a first reflective photo sensor 20*a*), and a controller (e.g., a controller 30). The charging unit charges a surface of the latent image bearing member. The charging power source outputs a charging bias to be supplied to the charging unit. The latent image writing unit writes a latent image on the surface of the latent image bearing member charged by the charging unit. The development unit develops the latent image to form a toner image. The transfer unit transfers the toner image on the surface of the latent image bearing member to a transfer member. The toner detector detects a toner adhesion amount on the surface of the latent image bearing member or a surface of the transfer member. The controller gradually changes a background potential serving as a potential difference between a background area of the latent image bearing member and a development member of the development unit while causing the latent image bearing member to rotate. This forms a background fog pattern on the surface of the latent image bearing member, the background fog pattern including only a blank area corresponding to the background area. The controller adjusts the charging bias from the charging power source based on a detection of a toner adhesion amount by the toner detector for each of sections of the background fog pattern in a direction of movement of the latent image bearing member. The controller develops a latent image to form a toner image used for position identification on the surface of the latent image bearing member in addition to the background fog pattern. The controller identifies a time when the toner image used for position identification has entered a detection range of the toner detector based on a change in outputs of the toner detector to determine a time when each of the sections enters the detection range based on the identified time.

In such a configuration, the image forming apparatus gradually changes a background potential while causing the latent image bearing member to rotate to form a background fog pattern on the surface of the latent image bearing member. The background fog pattern includes a plurality of sections having different background toner adhesion amounts. The background fog pattern includes only a blank area corresponding to the background area. In addition to the background fog pattern, the image forming apparatus develops a latent image to form a toner image used for position identification on the surface of the latent image bearing member, the toner image used for position identification facilitating transfer of toner to a latent image by a development potential. When this toner image used for position identification enters a detection range of the toner detector, output values of the toner detector change significantly. Hence, the image forming apparatus can accurately measure a time when the toner image used for position identification has entered the detection range based on a change in the output values of the toner detector. If the background fog pattern is formed near the toner image used for position identification, there is a time difference between the time when the toner image used for position identification has entered the detection range and a time when each of the sections of the background fog pattern enters the detection range. That is, this time difference is markedly smaller than a time difference between a time when the charging bias has begun to change gradually to form the background fog pattern and the time when each of the sections of the background fog pattern enters the detection range. When the time difference becomes smaller, the image forming apparatus can accurately determine the time when each of the sections of the background fog pattern enters the detection range, unlike a case where a clock process is performed based on a time when a charging bias has begun to change gradually as a reference. Therefore, the image forming apparatus can suppress background fog and carrier adhesion due to poor accuracy in determining a time when each of the sections of the background fog pattern enters a detection range.

[Aspect B]

In the image forming apparatus with the aspect A, when the background fog pattern is formed, the controller gradually changes the charging bias with the development bias to be supplied to the development member held constant to gradually change the background potential.

[Aspect C]

In the image forming apparatus with at least one of the aspects A and B, when the background fog pattern in formed, the controller gradually changes the charging bias from a value having a larger absolute value to a value having a smaller absolute value.

[Aspect D]

In the image forming apparatus with the aspect C, the controller forms the toner image used for position identification at an upstream side of the background fog pattern on the surface of the latent image bearing member in the direction of movement of the latent image bearing member.

[Aspect E]

In the image forming apparatus with any of the aspects A through D, a plurality of toner detectors are disposed. The plurality of toner detectors detects respective toner adhesion amounts in different positions in a direction along a surface of the background fog pattern and perpendicular to a movement direction of the background fog pattern. The controller uses a detection result acquired by each of the toner detectors to adjust the charging bias.

[Aspect F]

In the image forming apparatus with any of the aspects A through E, the toner detector is disposed at an inner edge of the background fog pattern in a direction along a surface of the background fog pattern and perpendicular to a movement direction of the background fog pattern.

[Aspect G]

In the image forming apparatus with any of the aspects A through F, the controller uses a toner adhesion amount only within a prescribed range based on the detection of the toner adhesion amount for each of the sections of the background fog pattern to adjust the charging bias.

[Aspect H]

In the image forming apparatus with any of the aspects A through G, an environment detector is disposed to detect environmental conditions. The controller determines a time when the charging bias according to the toner adhesion amount corresponding to each of the sections of the background fog pattern is adjusted based on a cumulative travel distance of the latent image bearing member and a detection result acquired by the environment detector.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus comprising:

a latent image bearing member;

a charging unit to charge a surface of the latent image bearing member;

a charging power source to output a charging bias to be supplied to the charging unit;

a latent image writing unit to write a latent image on the surface of the latent image bearing member charged by the charging unit;

a development unit to develop the latent image to form a toner image;

a transfer unit to transfer the toner image on the surface of the latent image bearing member to a transfer member;

a toner detector to detect a toner adhesion amount on the surface of the latent image bearing member or a surface of the transfer member;

a controller to gradually change a background potential serving as a potential difference between a background area of the latent image bearing member and a development member of the development unit while causing the latent image bearing member to rotate to form a background fog pattern, including only a blank area corresponding to the background area, on the surface of the latent image bearing member, and to adjust the charging bias from the charging power source based on a detection of the toner adhesion amount by the toner detector for each of sections of the background fog pattern in a direction of movement of the latent image bearing member; and an environment detector to detect environmental conditions, wherein the controller developing a latent image to form a toner image used for position identification on the surface of the latent image bearing member in addition to the background fog pattern, and identifying a time when the toner image used for position identification has entered a detection range of the toner detector based on a change in outputs of the toner detector to determine a time when each of the sections enters the detection range based on the identified time, wherein the controller determines an adjustment time when the charging bias according to the toner adhesion amount corresponding to each of the sections of the background fog pattern is adjusted based on cumulative travel distance of the latent image bearing member and a detection result acquired by the environment detector, and wherein the toner detector includes a plurality of sensors that are arranged in different positions in a transfer member width direction and at least one of the sensors detects only regular reflection light and the remaining sensors detect regular reflection light and diffuse reflection light.

2. The image forming apparatus according to claim 1, wherein, when the background fog pattern is formed, the controller gradually changes the charging bias with development bias to be supplied to the development member held constant to gradually change the background potential.

3. The image forming apparatus according to claim 1, wherein, when the background fog pattern in formed, the controller gradually changes the background potential from a larger value to a smaller value.

4. The image forming apparatus according to claim 3, wherein the controller forms the toner image used for position identification at an upstream side of the background fog pattern on the surface of the latent image bearing member in the direction of movement of the latent image bearing member.

5. The image forming apparatus according to claim 1, comprising a plurality of toner detectors to detect respective toner adhesion amounts in different positions in a direction along a surface of the background fog pattern and perpendicular to a movement direction of the background fog pattern, wherein the controller uses a detection result acquired by each of the toner detectors to adjust the charging bias.

6. The image forming apparatus according to claim 1, wherein the toner detector is disposed at an inner edge of the background fog pattern in a direction along a surface of the background fog pattern and perpendicular to a movement direction of the background fog pattern.

7. The image forming apparatus according to claim 1, wherein the controller uses a toner adhesion amount within a prescribed range based on detection of the toner adhesion amount for each of the sections of the background fog pattern to adjust the charging bias.

8. The image forming apparatus according to claim 1, wherein the charging bias is adjusted if the controller determines that the cumulative travel distance of the latent image bearing member has reached a predetermined threshold.

9. The image forming apparatus according to claim 8, wherein the charging bias is adjusted if the controller determines that the cumulative travel distance of the latent image bearing member has reached the predetermined threshold and the controller determines that the detected environmental conditions has reached a predetermined temperature threshold and/or not within a predetermined humidity range.

10. The image forming apparatus according to claim 8, wherein the predetermined threshold for cumulative travel distance of the image bearing member is 10 km.

11. An image forming method, comprising:

outputting charging bias from a charging power source to charge a latent image bearing member;

charging a surface of the latent image bearing member, with the charging bias by a charging unit;

writing a latent image on the surface of the latent image bearing member charged by the charging unit;

developing the latent image to form a toner image by a development unit;

transferring the toner image on the surface of the latent image bearing member to a transfer member;

detecting a toner adhesion amount on the surface of the latent image bearing member or a surface of the transfer member by a toner detector;

forming a background fog pattern on the surface of the latent image bearing member by gradually changing a background potential serving as a potential difference between a background area of the latent image bearing member and a development member of the development unit while causing the latent image bearing member to rotate, the background fog pattern including only a blank area corresponding to the background area;

detecting environmental conditions; and adjusting the charging bias from the charging power source based on the toner adhesion amount detected by the toner detector for each of sections of the background fog pattern in a movement direction, the adjusting including developing a latent image to form a toner image used for position identification on the surface of the latent image bearing member in addition to the background fog pattern, identifying a time when the toner image used for position identification has entered a detection range of the toner detector based on a change in outputs of the toner detector, and determining a time when each of the sections enters the detection range based on the identified time, wherein the identified time is determined when the charging bias according to the toner adhesion amount corresponding to each of the sections of the background fog pattern is adjusted based on cumulative travel distance of the latent image bearing member and the detected environmental conditions, and wherein the toner detector includes a plurality of sensors that are arranged in different positions in a transfer member width direction and at least one of the sensors detects only regular reflection light and the remaining sensors detect regular reflection light and diffuse reflection light.

* * * * *